US010166768B2

(12) United States Patent
Kiji

(10) Patent No.: US 10,166,768 B2
(45) Date of Patent: Jan. 1, 2019

(54) INK JET HEAD DRIVE DEVICE

(71) Applicant: TOSHIBA TEC KABUSHIKI KAISHA, Tokyo (JP)

(72) Inventor: Yasuhito Kiji, Mishima Shizuoka (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/661,552

(22) Filed: Jul. 27, 2017

(65) Prior Publication Data

US 2018/0072055 A1 Mar. 15, 2018

(30) Foreign Application Priority Data

Sep. 15, 2016 (JP) ..... 2016-180184

(51) Int. Cl.
*B41J 2/045* (2006.01)
*B41J 2/14* (2006.01)

(52) U.S. Cl.
CPC ..... *B41J 2/04588* (2013.01); *B41J 2/04541* (2013.01); *B41J 2/04581* (2013.01);
(Continued)

(58) Field of Classification Search
CPC B41J 2/04588; B41J 2/04541; B41J 2/04586; B41J 2/0455; B41J 2/0459;
(Continued)

(56) References Cited

U.S. PATENT DOCUMENTS 5,426,455 A * 6/1995 Williamson ..... B41J 2/04581 310/317
7,441,855 B2 10/2008 Takahashi et al.
(Continued)

FOREIGN PATENT DOCUMENTS

JP 3346454 B2 11/2002
JP 2006-188043 A 7/2006
JP 5591032 B2 9/2014

OTHER PUBLICATIONS

U.S. Appl. No. 15/145,242, filed May 3, 2016 (Inventor: Yasuhito Kiji).
(Continued)

*Primary Examiner* — Geoffrey Mruk
*Assistant Examiner* — Scott A Richmond
(74) *Attorney, Agent, or Firm* — Patterson & Sheridan, LLP

(57) ABSTRACT

An ink jet head drive device includes a pressure chamber in which a liquid can be contained, an actuator configured to change a pressure on the liquid in the pressure chamber by changing a volume of the pressure chamber in response to a drive signal, a nozzle through which the liquid contained in the pressure chamber can be ejected when an ejection pulse is supplied to the actuator, and a drive circuit configured to output the drive signal to the actuator as a drive waveform having a first pulse group and a second pulse group following the first pulse group when at least three consecutive ejection pulses are included in the drive waveform. All ejection pulses in the first pulse group have a first voltage amplitude, and all ejection pulses in the second pulse group have a second voltage amplitude that is smaller than the first voltage amplitude.

17 Claims, 27 Drawing Sheets

(52) U.S. Cl.
CPC ..... *B41J 2/04586* (2013.01); *B41J 2/04595* (2013.01); *B41J 2/14209* (2013.01); *B41J 2002/14491* (2013.01); *B41J 2202/12* (2013.01)

(58) Field of Classification Search
CPC ..... B41J 2/04591; B41J 2/04593; B41J 2/04595; B41J 2/18
See application file for complete search history.

(56) References Cited

U.S. PATENT DOCUMENTS

| | | | | |
|---|---|---|---|---|
| 8,057,001 | B2 | 11/2011 | Shingyohuchi et al. | |
| 2012/0306954 | A1* | 12/2012 | Nishikawa | B41J 2/04516 347/11 |
| 2015/0375518 | A1* | 12/2015 | Sugitani | B41J 2/17596 347/6 |

OTHER PUBLICATIONS

Extended Search Report dated Feb. 23, 2018, filed in counterpart European Patent Application No. 17189859.6 (7 pages).

* cited by examiner

FIG. 11

CHANGE OF PULSE WIDTH

AL:2.2[μs],PULSE INTERVAL:4.4[μs],V1:16[V],V2:25[V],cp:3.4[μs]

| NUMBER OF CONSECUTIVELY EJECTED DROPLETS | PULSE WIDTH OF SECOND EJECTION PULSE GROUP G2 [μs] | EJECTION SPEED [m/s] | EJECTION VOLUME [pL] |
|---|---|---|---|
| 1 | – | 9.623 | 5.08 |
| 2 | 2.20 | 10.072 | 11.25 |
| 3 | 1.40 | 10.329 | 17.88 |
| 4 | 1.30 | 10.795 | 25.43 |
| 5 | 1.15 | 10.249 | 31.78 |
| 6 | 1.20 | 10.323 | 39.95 |
| 7 | 1.20 | 10.110 | 46.95 |

FIG. 16

COMPARISON OF DROPLET SPEED IN DRIVE WAVEFORM 55-2
(NUMBER OF DROPLETS = 2)
AL:2.2[μs],PULSE INTERVAL:4.4[μs],V2:25[V],cp:3.4[μs],
VOLTAGE OF NEGATIVE PULSE-V2:-25[V]

| PULSE WIDTH dp-2´ OF SECOND EJECTION PULSE OF FIRST EJECTION PULSE GROUP G1 [μs] | SPEED OF FIRST (INITIAL) DROPLET [m/s] | SPEED OF SECOND (LAST) DROPLET [m/s] |
|---|---|---|
| 2.2 | 14.03 | 14.03 |
| 2.1 | 13.81 | 13.81 |
| 2.0 | 13.78 | 13.78 |
| 1.9 | 13.43 | 13.43 |
| 1.8 | 13.53 | 13.53 |
| 1.7 | 13.44 | 13.44 |
| 1.6 | 13.02 | 13.02 |
| 1.5 | 12.69 | 12.69 |
| 1.4 | 11.90 | 11.90 |
| 1.3 | 11.56 | 11.56 |
| 1.2 | 11.21 | 11.21 |
| 1.1 | 10.87 | 10.87 |
| 1.0 | 10.41 | 10.41 |
| 0.9 | 9.70 | 9.70 |
| 0.8 | 9.55 | 9.55 |
| 0.7 | 9.59 | 8.73 |
| 0.6 | 9.58 | 7.53 |

FIG. 18

COMPARISON OF DROPLET SPEED IN DRIVE WAVEFORM 55-3
(NUMBER OF DROPLETS = 3)
AL:2.2[μs],PULSE INTERVAL:4.4[μs],V2:25[V],cp:3.4[μs],
VOLTAGE OF NEGATIVE PULSE-V2:-25[V],dp-2':0.8[μs],dp-3':2.2[μs]

| VOLTAGE V1´ OF EJECTION PULSE OF SECOND EJECTION PULSE GROUP G2 [V] | SPEED OF FIRST (INITIAL) DROPLET [m/s] | SPEED OF THIRD (LAST) DROPLET [m/s] |
|---|---|---|
| 14 | 10.13 | 10.13 |
| 13 | 10.30 | 10.30 |
| 12 | 10.28 | 10.28 |
| 11 | 9.92 | 9.92 |
| 10 | 9.80 | 9.80 |
| 9 | 9.76 | 9.76 |
| 8 | 9.03 | 9.03 |
| 7 | 9.01 | 9.30 |

FIG. 20

COMPARISON OF DROPLET SPEED IN DRIVE WAVEFORM 55-7
(NUMBER OF DROPLETS = 7)
AL:2.2[μs],PULSE INTERVAL:4.4[μs],V2:25[V],cp:3.4[μs],
VOLTAGE OF NEGATIVE PULSE-V2:-25[V],dp-2':0.8[μs],dp-7':2.2[μs]

| VOLTAGE V1´ OF EJECTION PULSE OF SECOND EJECTION PULSE GROUP G2 [V] | SPEED OF FIRST (INITIAL) DROPLET [m/s] | SPEED OF SEVENTH (LAST) DROPLET [m/s] |
|---|---|---|
| 14 | 13.01 | 13.01 |
| 13 | 12.11 | 12.11 |
| 12 | 10.77 | 11.26 |
| 11 | 9.25 | 10.13 |
| 10 | 9.67 | 8.57 |
| 9 | 9.47 | 7.31 |
| 8 | 9.13 | 6.44 |
| 7 | 8.55 | 4.90 |

FIG. 22

EJECTION SPEED AND EJECTION VOLUME

AL:2.2[μs],PULSE INTERVAL:4.4[μs],V2:25[V],cp:3.4[μs],
VOLTAGE OF NEGATIVE PULSE-V2:-25[V],dp-2':0.8[μs],V1':11[V],

| NUMBER OF CONSECUTIVELY EJECTED DROPLETS | PULSE WIDTH OF SECOND EJECTION PULSE GROUP G2[μs] | EJECTION SPEED [pL] | EJECTION VOLUME [m/s] |
|---|---|---|---|
| 1 | – | 9.62 | 5.08 |
| 2 | – | 9.55 | 10.77 |
| 3 | 1.4 | 9.69 | 16.88 |
| 4 | 1.9 | 10.25 | 24.41 |
| 5 | 2.1 | 9.91 | 31.84 |
| 6 | 2.1 | 10.40 | 38.38 |
| 7 | 2.1 | 10.13 | 45.59 |

FIG. 24

AMOUNT OF CONVEX MENISCUS [pL]

AL:2.2[μs],PULSE INTERVAL:4.4[μs],V1':11[V],V2:25[V],dp-2':0.8[μs],
VOLTAGE OF NEGATIVE PULSE-V2:-25[V],

| PULSE WIDTH cp OF NEGATIVE PULSE [μs] / NUMBER OF CONSECUTIVELY EJECTED DROPLETS | 0.8 | 1 | 1.2 | 1.4 | 1.6 | 1.8 | 2 | 2.2 | 2.4 | 2.6 | 2.8 | 3 | 3.2 | 3.4 | 3.6 | 3.8 | 4 | PULSE WIDTH OF SECOND EJECTION PULSE GROUP G2 [μs] |
|---|---|---|---|---|---|---|---|---|---|---|---|---|---|---|---|---|---|---|
| 1 | 0.55 | 0.31 | 0.37 | 0.43 | 0.50 | 0.66 | 1.00 | 0.97 | 1.16 | 1.03 | 0.85 | 0.58 | 0.21 | 0.21 | 0.29 | 0.64 | 1.38 | – |
| 2 | 2.90 | 2.47 | 2.20 | 2.27 | 2.34 | 2.38 | 2.39 | 2.38 | 2.28 | 2.16 | 2.03 | 1.89 | 1.75 | 2.08 | 2.13 | 2.60 | 3.45 | – |
| 3 | 2.63 | 2.33 | 2.37 | 2.45 | 2.51 | 2.64 | 2.66 | 2.66 | 2.56 | 2.36 | 2.22 | 1.95 | 1.88 | 1.70 | 1.83 | 2.20 | 2.96 | 1.4 |
| 4 | 1.56 | 1.10 | 1.19 | 1.35 | 1.45 | 1.49 | 1.55 | 1.53 | 1.45 | 1.28 | 1.12 | 0.95 | 0.76 | 0.97 | 1.12 | 1.66 | 2.51 | 1.9 |
| 5 | 1.15 | 0.51 | 0.38 | 0.53 | 0.70 | 0.84 | 0.93 | 0.86 | 0.76 | 0.64 | 0.41 | 0.37 | 0.19 | 0.11 | 0.45 | 1.18 | 2.47 | 2.1 |
| 6 | 1.96 | 1.38 | 1.38 | 1.42 | 1.49 | 1.59 | 1.64 | 1.66 | 1.53 | 1.39 | 1.14 | 0.96 | 0.88 | 0.87 | 1.25 | 1.78 | 2.83 | 2.1 |
| 7 | 1.87 | 1.29 | 1.20 | 1.23 | 1.29 | 1.37 | 1.39 | 1.41 | 1.31 | 1.23 | 0.96 | 0.89 | 0.69 | 0.78 | 1.01 | 1.49 | 2.61 | 2.1 |

| NUMBER OF CONSECUTIVELY EJECTED DROPLETS | PULSE WIDTH OF NEGATIVE PULSE [μs] | |
|---|---|---|
| | LOWER LIMIT | UPPER LIMIT |
| 1 | 3.2 | 3.6 |
| 2 | 2.6 | 3.6 |
| 3 | 2.8 | 3.8 |
| 4 | 3 | 3.4 |
| 5 | 3 | 3.4 |
| 6 | 2.8 | 3.6 |
| 7 | 2.8 | 3.6 |

INK JET HEAD DRIVE DEVICE

CROSS-REFERENCE TO RELATED APPLICATION

This application is based upon and claims the benefit of priority from Japanese Patent Application No. 2016-180184, filed Sep. 15, 2016, the entire contents of which are incorporated herein by reference.

FIELD

Embodiments described herein relate generally to an ink jet head drive device.

BACKGROUND

An ink jet head driving device adjusts the dispensed ink amount by ejecting a different number of droplets of ink several times per location. This driving device includes a drive circuit which controls the ejection of droplets. The drive circuit outputs a high-frequency drive signal to an actuator of an ink jet head to control the ejection of droplets.

BRIEF DESCRIPTION OF THE DRAWINGS

FIG. 11 shows simulation results illustrating a relationship between the number of droplets consecutively ejected and an ejection speed/ejection volume for various pulse widths for each ejection pulse of the second ejection pulse group.

FIG. 16 depicts simulation results illustrating a droplet speed for various pulse widths for a second ejection pulse of the first ejection pulse group.

FIG. 18 depicts simulation results of a droplet speed for various values for a voltage of the ejection pulses of the second ejection pulse group.

FIG. 20 depicts simulation results of a droplet speed for various values for the voltage of the ejection pulses of the second ejection pulse group.

FIG. 22 depicts a relationship between a number of droplets to be consecutively ejected, the ejection speed, and the ejection volume.

FIG. 24 depicts simulation results of a maximum value of a convex meniscus for various numbers of consecutively ejected droplets and various pulse widths for a negative pulse.

DETAILED DESCRIPTION

Figure 1:
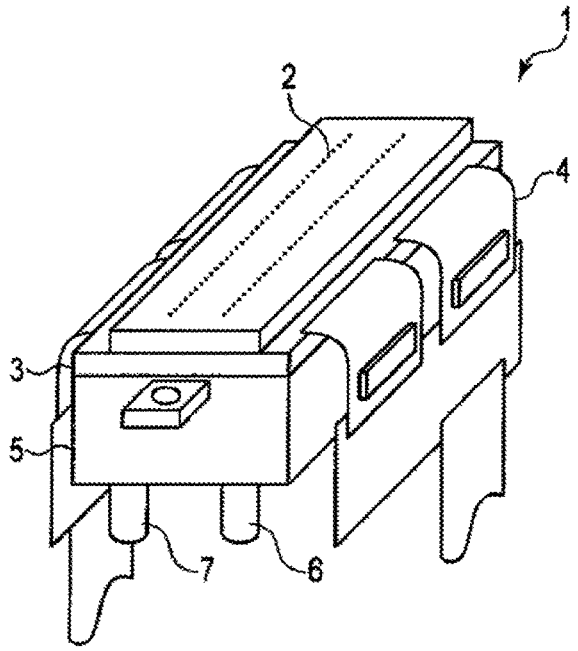
FIG. 1 shows a perspective diagram of an ink jet head according to an embodiment.

In general, according to one embodiment, an ink jet head drive device includes a pressure chamber in which a liquid can be contained, an actuator configured to change a pressure on the liquid in the pressure chamber by changing a volume of the pressure chamber in response to a drive signal, a nozzle connected to the pressure chamber and through which the liquid contained in the pressure chamber can be ejected when an ejection pulse is supplied to the actuator, and a drive circuit configured to output the drive signal to the actuator as a drive waveform having a first pulse group and a second pulse group following the first pulse group when at least three consecutive ejection pulses are included in the drive waveform. All ejection pulses in the first pulse group have a first voltage amplitude, and all ejection pulses in the second pulse group have a second voltage amplitude that is smaller than the first voltage amplitude.

In an ink jet head, a drive circuit outputs a high-frequency signal. The drive circuit repeatedly outputs high-frequency signals, and thus the temperature of the drive circuit tends to rise. To suppress the rise in temperature of the drive circuit, it is sufficient to set a waiting time for the drive circuit to dissipate heat after a droplet is ejected before a next droplet is ejected. However, in this case, an ejection frequency decreases, and thus a printing speed decreases.

Hereinafter, example embodiments will be described with reference to the drawings. In the diagrams, identical or equivalent parts are denoted by the same reference numerals.

First Embodiment

FIG. 1 shows a perspective diagram of an ink jet head 1. The ink jet head 1 is used in an ink jet recording apparatus. The ink jet recording apparatus is an ink jet type printer.

The inkjet head 1 includes a nozzle 2, a head substrate 3, a drive circuit 4, and a manifold 5. The manifold 5 includes an ink supply port 6 and an ink discharge port 7.

The nozzle 2 is a component that ejects ink. The nozzle 2 is located on the head substrate 3. The drive circuit 4 is a drive signal output unit that outputs a drive signal for ejecting ink droplets from the nozzle 2. The drive circuit 4 is, for example, a driver IC. The ink supply port 6 supplies ink to the nozzle 2. The ink discharge port 7 discharges an ink. The nozzle 2 ejects ink droplets supplied from the ink supply port 6 in response to a drive signal from the drive circuit 4. Ink that is not ejected from the nozzle 2 is discharged from the ink discharge port 7.

Figure 2:
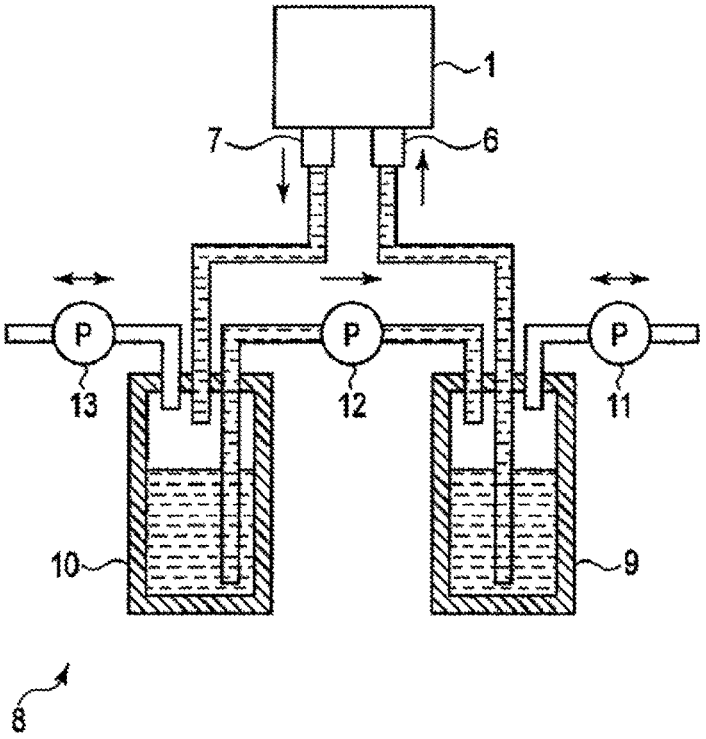
FIG. 2 shows a schematic diagram of an ink supply device used in an ink jet recording apparatus according to an embodiment.

FIG. 2 shows a schematic diagram of an ink supply device 8 used in an ink jet recording apparatus. The ink supply device 8 supplies ink to the ink jet head 1. The ink supply device 8 includes a supply-side ink tank 9, a discharge-side ink tank 10, a supply-side pressure adjustment pump 11, a transport pump 12, and a discharge-side pressure adjustment pump 13. These are connected by tubes through which ink can flow. The supply-side ink tank 9 is connected to the ink supply port 6 via a tube, and the discharge-side ink tank 10 is connected to the ink discharge port 7 via a tube.

The supply-side pressure adjustment pump 11 adjusts the pressure of the supply-side ink tank 9. The discharge-side pressure adjustment pump 13 adjusts the pressure of the discharge-side ink tank 10. The supply-side ink tank 9 supplies ink to the ink supply port 6 of the ink jet head 1. The discharge-side ink tank 10 temporarily stores the ink discharged from the ink discharge port 7 of the ink jet head 1. The transport pump 12 returns the ink stored in the discharge-side ink tank 10 to the supply-side ink tank 9 via a tube.

Next, the ink jet head 1 will be described in detail.

Figure 3:
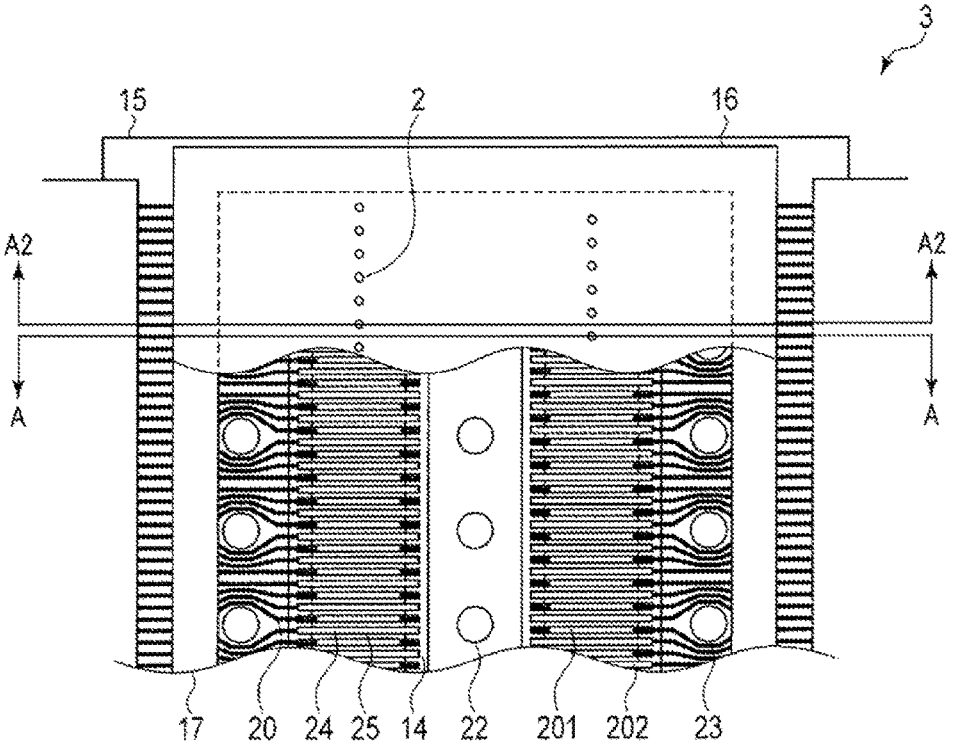
FIG. 3 shows a plan diagram of a head substrate in an ink jet head according to an embodiment.
Figure 4A:
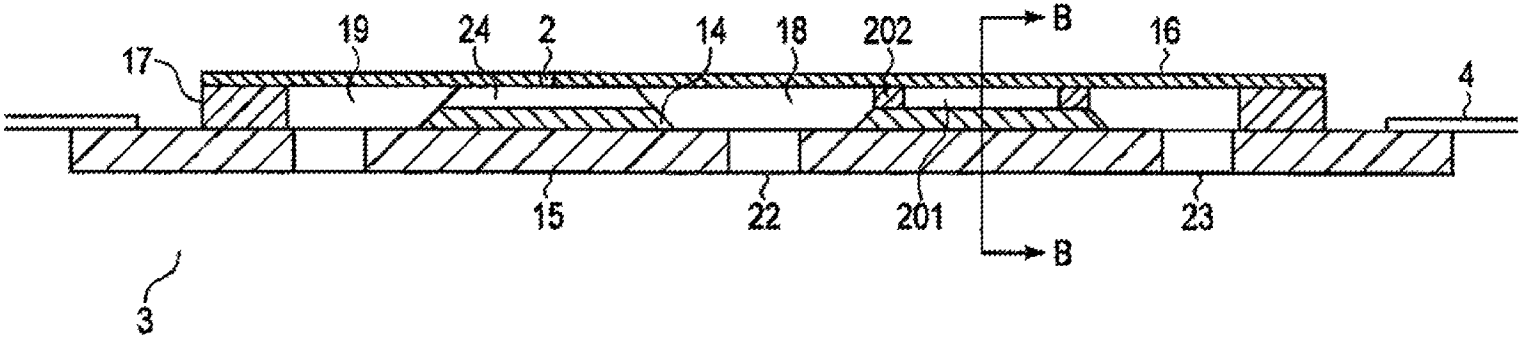
FIG. 4A is a cross-sectional diagram taken along the line A2-A2 of the head substrate shown in FIG. 3.
Figure 4B:
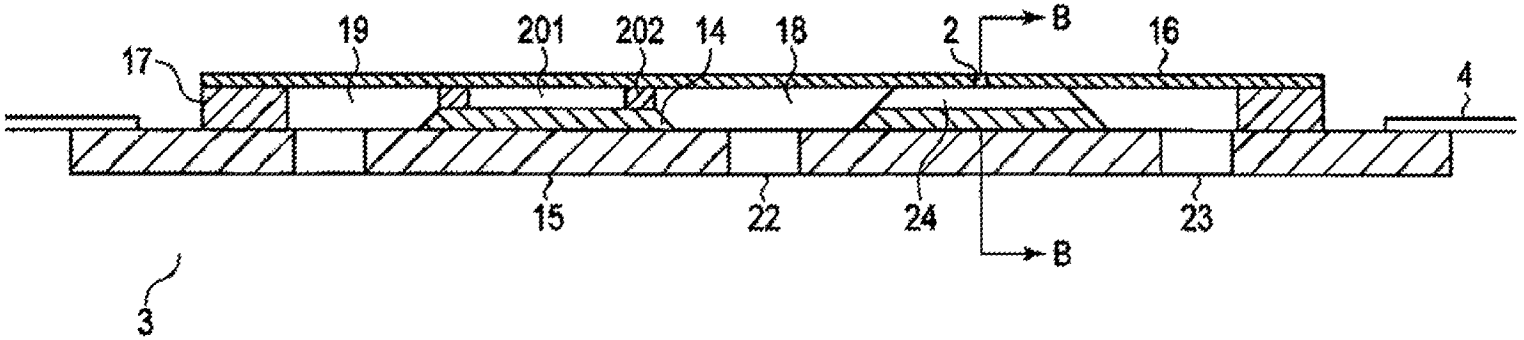
FIG. 4B is a cross-sectional diagram taken along the line A-A of the head substrate shown in FIG. 3.
Figure 5A:
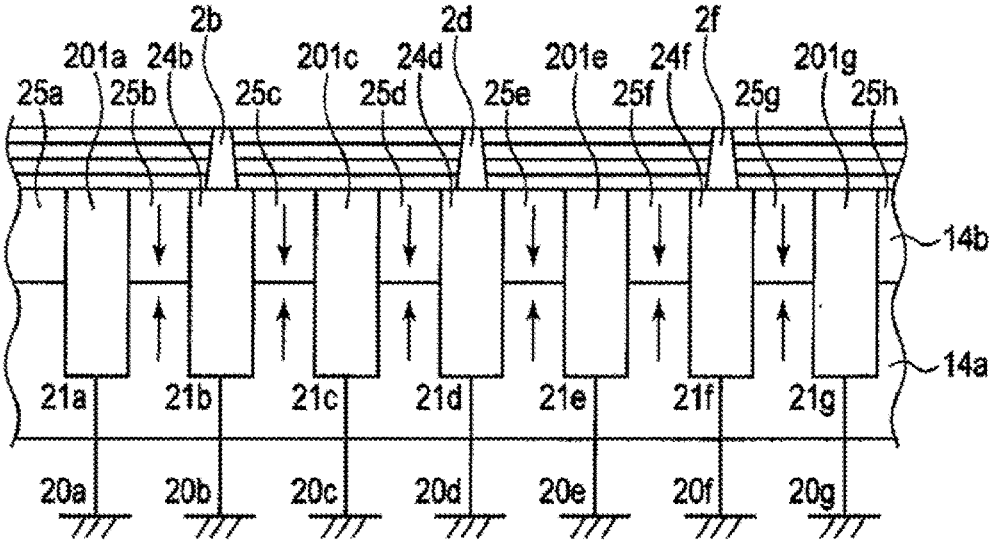
FIGS. 5A and 5B show cross-sectional diagrams taken along the line B-B of the head substrate shown in FIG. 4B.
Figure 5B:
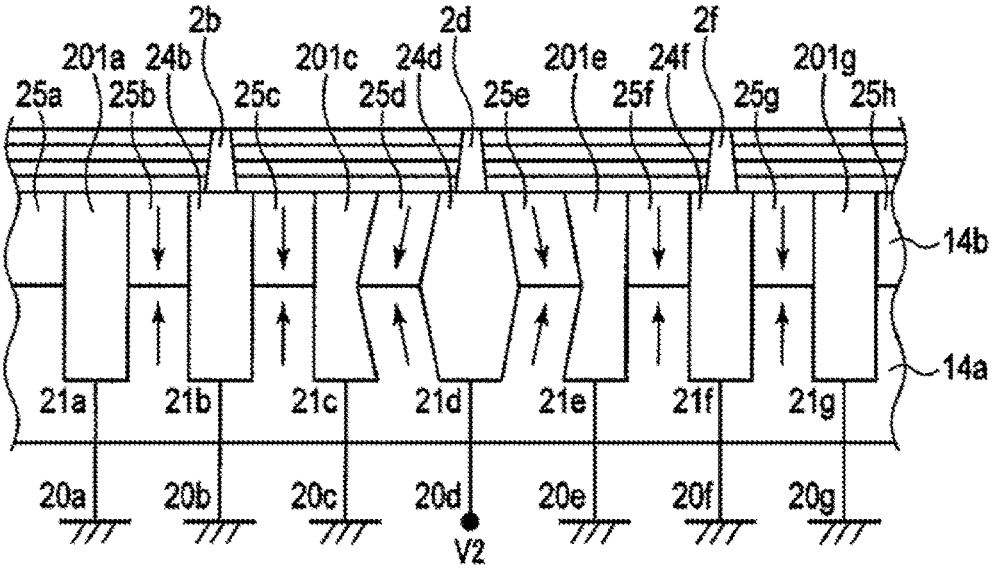

FIG. 3 shows a plan diagram of the head substrate 3 of the ink jet head 1. FIG. 4A is a cross-sectional diagram taken along the line A2-A2 of the head substrate 3 shown in FIG. 3. FIG. 4B is a cross-sectional diagram taken along a line A-A of the head substrate 3 shown in FIG. 3. FIGS. 5A and 5B are cross-sectional diagrams taken along the line B-B of the head substrate 3 shown in FIGS. 4A and 4B.

As shown in FIG. 3, the head substrate 3 includes a piezoelectric member 14, a base substrate 15, a nozzle plate 16, and a frame member 17. As shown in FIGS. 4A and 4B, the central space surrounded by the base substrate 15, the piezoelectric member 14 and the nozzle plate 16 is an ink supply path 18. The space surrounded by the base substrate 15, the piezoelectric member 14, the frame member 17 and the nozzle plate 16 is an ink discharge path 19.

The piezoelectric member 14 includes a plurality of long grooves extending from the ink supply path 18 to the ink discharge path 19. Each of these long grooves is a pressure chamber 24 or an air chamber 201. The pressure chamber 24 and the air chamber 201 are alternately arranged. The air chamber 201 is formed by closing both ends of a long groove with a lid 202. By closing both ends of the long groove with the lid 202, ink in the ink supply path 18 and the ink discharge path 19 is prevented from flowing into the air chamber 201. The lid 202 is formed by, for example, a light-activated resin.

As shown in FIG. 3, in the base substrate 15, a wiring electrode 20 is formed. On the inner surface of the pressure chamber 24 and an air chamber 201, an electrode 21 is formed. The wiring electrode 20 electrically connects the electrode 21 and the drive circuit 4. In the base substrate 15, ink supply holes 22 and the ink discharge holes 23 are formed. The ink supply holes 22 communicate with the ink supply path 18 and the ink discharge holes 23 communicate with the ink discharge path 19. The ink supply holes 22 are linked with the ink supply port 6 of the manifold 5. The ink discharge holes 23 are linked with the ink discharge port 7 of the manifold 5.

The base substrate 15 includes, for example, a material having a small dielectric constant and a small difference in coefficient of thermal expansion from the piezoelectric member. As a material of the base substrate 15, it is possible to use alumina (Al2O3), silicon nitride (Si3N4), silicon carbide (SiC), aluminum nitride (AlN), lead zirconate titanate (PZT), or the like. In the first embodiment, the base substrate 15 includes low dielectric constant PZT.

On the base substrate 15, the piezoelectric member 14 is bonded. As shown in FIGS. 5A and 5B, the piezoelectric member 14 is formed by stacking the piezoelectric member 14*a* and the piezoelectric member 14*b*. The polarization direction of the piezoelectric member 14*a* and the piezoelectric member 14*b* are opposite to each other along the plate thickness direction. In the piezoelectric member 14, a plurality of long grooves connecting from the ink supply path 18 to the ink discharge path 19 are formed in parallel.

On the inner surface of each long groove, the electrode 21, also referred to as 21*a*, 21*b*, . . . 21*g* when individually addressed, is formed. The space surrounded by the long grooves and the one face of the nozzle plate 16 covering the long grooves is the pressure chamber 24 and the air chamber 201. In the example of FIG. 5A, each of the spaces indicated by reference numerals 24*b*, 24*d* and 24*f* is the pressure chamber 24, and each of the spaces indicated by reference numerals 201*a*, 201*c*, 201*e*, and 201*g* is the air chamber 201.

As described above, the pressure chamber 24 and the air chamber 201 are alternately arranged. The electrode 21 is connected to the drive circuit 4 through the wiring electrode 20. The piezoelectric member 14 acting as a partition wall of the pressure chamber 24 is sandwiched between the electrodes 21 provided in each of the pressure chambers 24. The piezoelectric member 14 and the electrode 21 constitute an actuator 25.

The drive circuit 4 applies an electric field to the actuator 25 by a drive signal. The actuator 25 undergoes shear deformation by the applied electric field as the top of the junction between the piezoelectric member 14*a* and the piezoelectric member 14*b*, like the actuators 25*d* and 25*e* in FIG. 5B. As the actuator 25 is deformed, the volume of the pressure chamber 24 changes. Due to the change in the volume of the pressure chamber 24, the ink inside the pressure chamber 24 is pressurized or decompressed. Due to this pressurization or decompression, the ink is ejected from the nozzle 2. As the piezoelectric member 14, lead titanate zirconate (PZT: Pb (Zr, Ti)O3), lithium niobate (LiNbO3), lithium tantalate (LiTaO3), or the like is used. In the first embodiment, the piezoelectric member 14 is lead zirconate titanate (PZT) having a high piezoelectric constant.

The electrode 21 has a two-layer structure of nickel (Ni) and gold (Au). The electrode 21 is formed uniformly as a film in the long groove by, for example, a plating method. As a method of forming the electrode 21, a sputtering method or an evaporation method can be used in addition to a plating method. The long groove has, for example, a depth of 300.0 μm and a width of 80.0 μm, and is arranged in parallel with one another at a pitch of 169.0 μm. As described above, each of the long grooves is the pressure chamber 24 or the air chamber 201. The pressure chamber 24 and the air chamber 201 are alternately arranged.

The nozzle plate 16 is bonded onto the piezoelectric member 14. The nozzle 2 is formed in the longitudinal center portion of the pressure chamber 24 of the nozzle plate 16. The material of the nozzle plate 16 is, for example, a metal material such as stainless steel, an inorganic material such as single crystal silicon, or a resin material such as a polyimide film. In the first embodiment, as an example, the material of the nozzle plate 16 is a polyimide film.

The nozzle 2 is formed, for example, by bonding the nozzle plate 16 to the piezoelectric member 14 and then processing the hole with an excimer laser or the like. The nozzle 2 is tapered from the pressure chamber 24 side to the ink ejection side. When the material of the nozzle plate 16 is stainless steel, the nozzle 2 can be formed by pressing. When the material of the nozzle plate 16 is single crystal silicon, the nozzle 2 can be formed by dry etching or wet etching in photolithography.

The above-described ink jet head 1 includes the ink supply path 18 at one end of the pressure chamber 24, the ink discharge path 19 at the other end, and the nozzle 2 at the center of the pressure chamber 24. The ink jet head 1 is not limited to this configuration example. For example, the ink jet head may have a nozzle at one end of the pressure chamber 24 and an ink supply path at the other end.

Next, an operation principle of the ink jet head 1 according to the first embodiment will be described.

FIG. 5A shows the head substrate 3 in a state in which a ground voltage is applied to all the electrodes 21*a* to 21*g* via wiring electrodes 20*a* to 20*g*. In FIG. 5A, since all the electrodes are at the same potential, no electric field is applied to the actuators 25*a* to 25*h*. Thus, the actuators 25*a* to 25*h* are not deformed. FIG. 5B shows the head substrate 3 in a state in which a voltage V2 is applied only to the electrode 21*d*. In FIG. 5B, a potential difference is generated between the electrode 21*d* and the electrodes 21*c* and 21*e* on both sides. The actuators 25*d* and 25*e* undergo shear deformation to expand the volume of the pressure chamber 24*d* by the applied potential difference. When the voltage of the electrode 21*d* is returned to a ground voltage, the actuators 25*d* and 25*e* return from the state of FIG. 5B to the state of FIG. 5A so that droplets are ejected from the nozzle 2*d*.

Figure 6A:
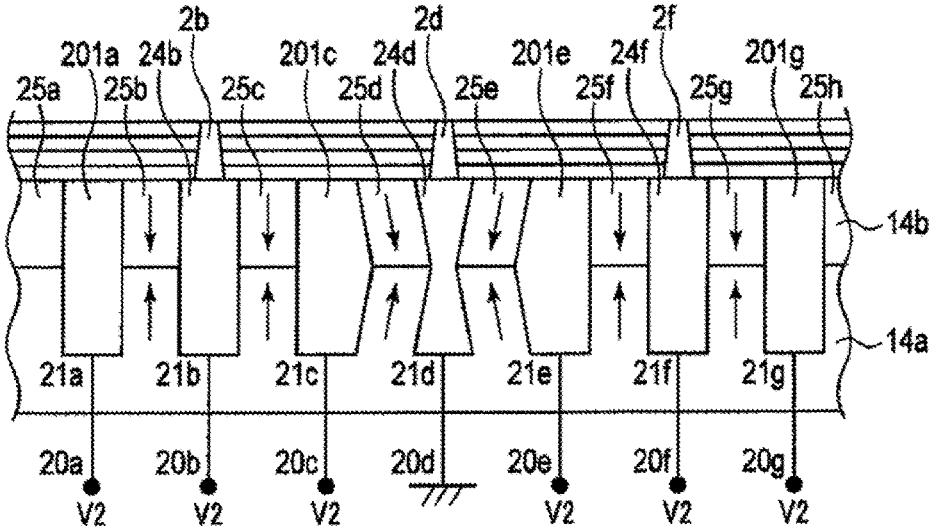
FIGS. 6A and 6B depict a state in which the volume of one pressure chamber is contracted.
Figure 6B:
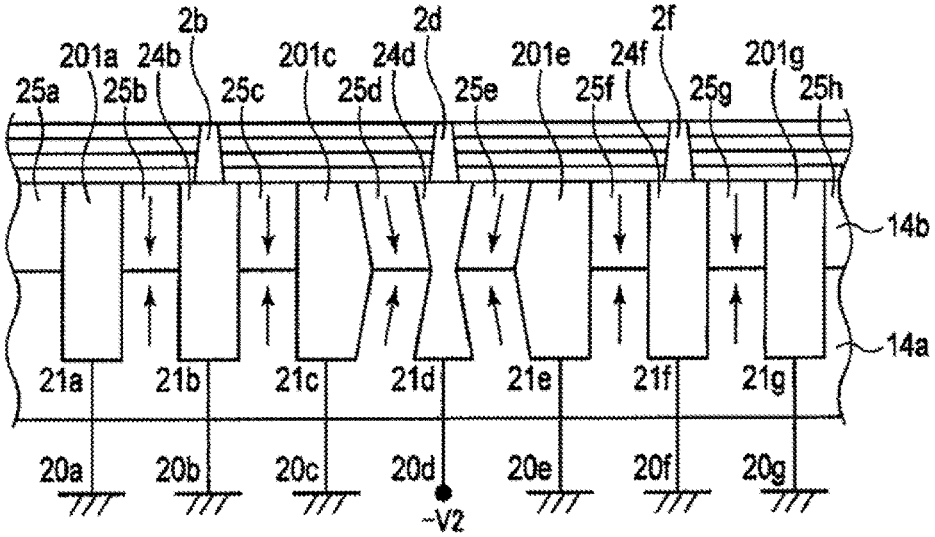

FIGS. 6A and 6B are cross-sectional diagrams taken along the line B-B of the head substrate 3 shown in FIGS. 4A and 4B. In FIGS. 6A and 6B, the pressure chamber 24*d* contracts. In FIGS. 6A and 6B, the actuators 25*d* and 24*e* are deformed into a shape opposite to the state shown in FIG. 5B.

FIG. 6A shows a state in which the electrode 21*d* is set to a ground voltage and the head substrate 3 in a state in which the voltage V2 is applied to the electrodes 21*a*, 21*c*, 21*e*, and 21*g* of the air chambers 201*a*, 201*c*, 201*e*, and 201*g*, respectively. In FIG. 6A, a potential difference opposite to that in FIG. 5B is generated between the electrode 21*d* and the electrodes 21*c* and 21*e* on both sides. Due to these potential differences, the actuators 25*d* and 25*e* undergo shear deformation in the direction opposite to that shown in FIG. 5B. FIG. 6A shows a state in which the voltage V2 is applied also to the electrodes 21*b* and 21*f*. As a result, the actuators 25*b*, 25*c*, 25*f*, and 25*g* are not deformed. If the actuators 25*b*, 25*c*, 25*f*, and 25*g* are not deformed, the pressure chambers 24*b* and 24*f* do not contract.

FIG. 6B shows the head substrate 3 a state in which the voltage applied to the electrode 21*d* is a voltage −V2 and the voltage applied to the electrodes 21*a*, 21*b*, 21*c*, 21*e*, 21*f*, and 21*g* is a ground voltage, respectively. Even in the state shown in FIG. 6B, a potential difference opposite to that in FIG. 5B is generated between the electrode 21*d* and the electrodes 21*c* and 21*e* on both sides. Due to these potential differences, the actuators 25*d* and 25*e* undergo shear deformation in the direction opposite to that shown in FIG. 5B.

Figure 7:
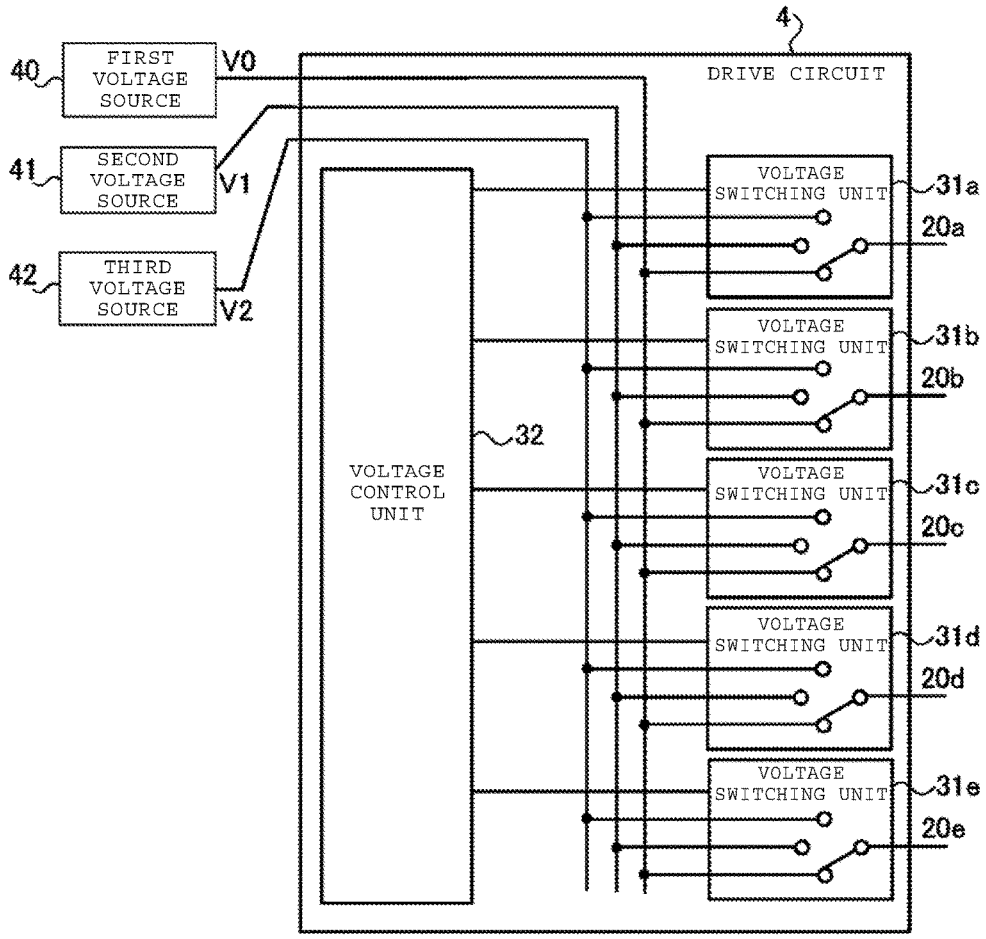
FIG. 7 is a diagram illustrating a first configuration example of a drive circuit.

FIG. 7 is a diagram showing a first configuration example of the drive circuit 4. The drive circuit 4 includes voltage switching units 31, the number of which is equal to the number of pressure chambers and air chambers inside the head. However, for simplicity, in FIG. 7, only the voltage switching units 31*a*, 31*b*, . . . , and 31*e* are shown. The drive circuit 4 includes a voltage control unit 32.

The drive circuit 4 is connected to a first voltage source 40, a second voltage source 41, and a third voltage source 42. The drive circuit 4 selectively applies the voltage supplied from each voltage source 40, 41, and 42 to the corresponding wiring electrode 20. In the first example shown in FIG. 7, the output voltage of the first voltage source 40 is a ground voltage, and the voltage value thereof is a voltage value V0 (V0=0 [V]). In addition, the output voltage of the second voltage source 41 is a voltage value V1 which is higher than the voltage value V0. The output voltage of the third voltage source 42 is a voltage value V2 which is higher than the voltage value V1.

The voltage switching unit 31 includes, for example, a semiconductor switch. Voltage switching units 31*a*, 31*b*, . . . , and 31*e* are connected to the wiring electrodes 20*a*, 20*b*, . . . , and 20*e*, respectively. The voltage switching unit 31 is connected to voltage sources 40, 41, and 42 via wires drawn into the drive circuit 4. The voltage switching unit 31 includes a changeover switch for switching the voltage source connected to the wiring electrode 20. The voltage switching unit 31 uses this changeover switch to switch the voltage source connected to the wiring electrode 20. For example, the voltage switching unit 31*a* connects with any one of the voltage sources 40, 41, and 42 and the wiring electrode 20*a* by the changeover switch.

The voltage control unit 32 is connected to the voltage switching units 31*a*, 31*b*, . . . , and 31*e*, respectively. The voltage control unit 32 outputs a command indicating which one of the first to third voltage sources 40, 41 and 42 is to be selected to each of the voltage switching units 31. For example, the voltage control unit 32 receives print data from the outside of the drive circuit 4 and determines the timing of switching the voltage source in each of the voltage switching units 31. Then, the voltage control unit 32 outputs a command to select one of the voltage sources 40, 41, and 42 to the voltage switching unit 31 at the determined switching timing. According to the command from the voltage control unit 32, the voltage switching unit 31 switches the voltage source connected to the wiring electrode 20.

Figure 8A:
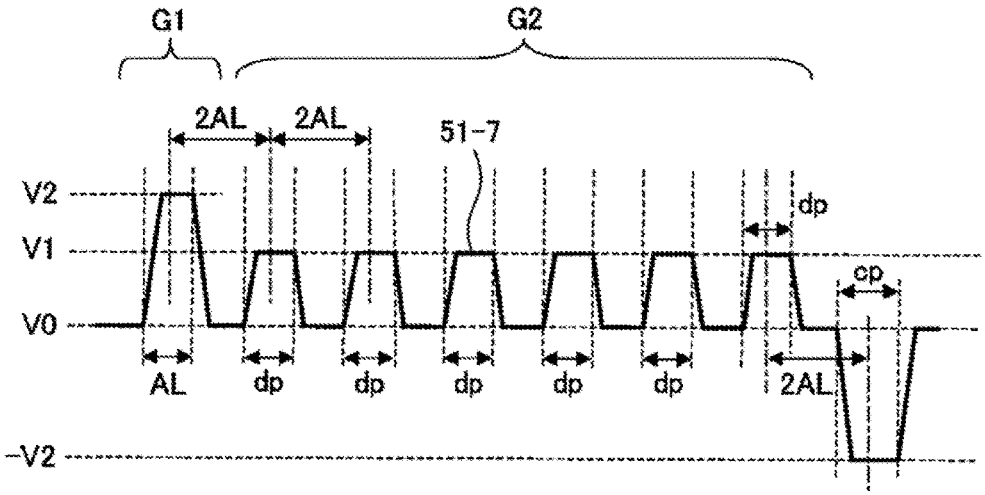
FIG. 8A shows a drive waveform when 7 droplets are consecutively ejected.
Figure 8B:
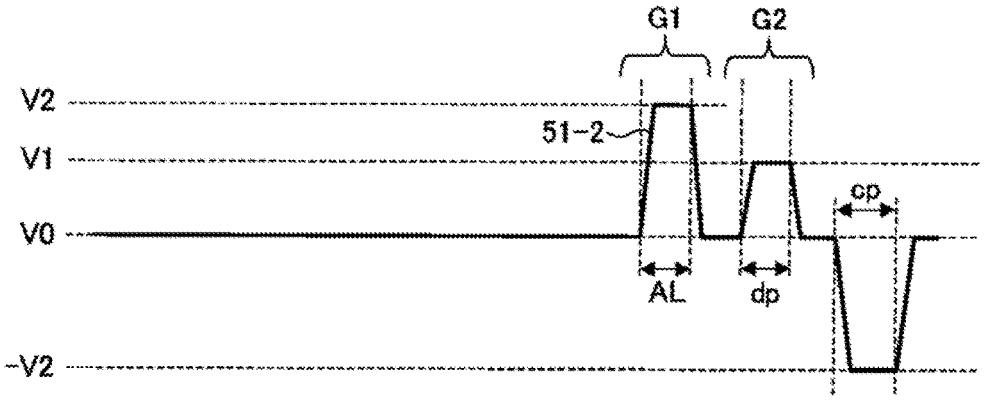
FIG. 8B shows a drive waveform when 2 droplets are ejected.
Figure 8C:
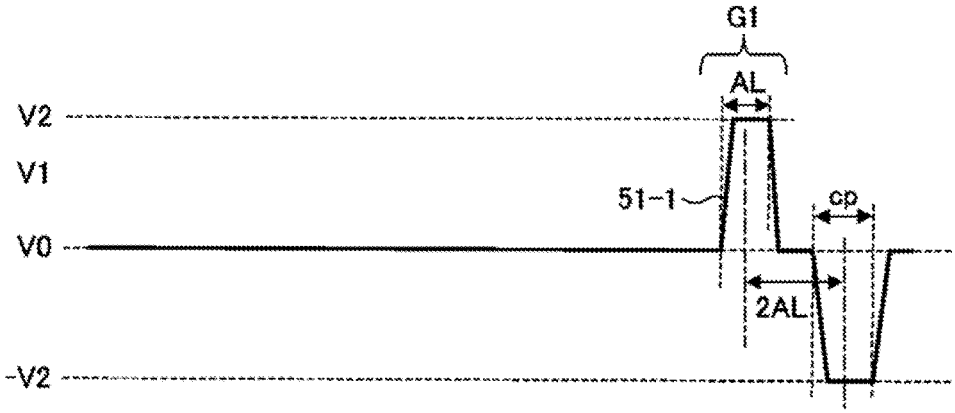
FIG. 8C shows a drive waveform when only one droplet is ejected.

FIGS. 8A to 8C are diagrams showing examples of a drive waveform of a drive signal applied from the drive circuit 4 to the electrode 21. FIG. 8A is a drive waveform 51-7 when 7 droplets are consecutively ejected. FIG. 8B is a drive waveform 51-2 when 2 droplets are consecutively ejected. FIG. 8C shows a drive waveform 51-1 where one droplet is to be ejected. The illustration of an example of a drive waveform in which the number of droplets is 3 to 6 will be omitted.

In FIGS. 8A and 8C, the horizontal axis represents time and the vertical axis represents the voltage difference. The voltages shown in FIGS. 8A to 8C show the voltage difference between the wiring electrodes 20 connected to the electrodes on the inner walls of the air chamber 201 on both sides. Hereinafter, this voltage difference is simply referred to as a voltage. That is, the voltage of the electrode of the pressure chamber refers to a voltage based on the voltage of the electrode of the adjacent air chamber.

The drive waveforms shown in FIGS. 8A to 8C are assumed to be applied to the electrode 21*d* shown in FIG. 5A. In this case, the air chambers on both sides are the air chambers 201*c* and 201*e*. The electrodes on the inner walls of air chambers 201*c* and 201*e* on both sides are electrodes 21*c* and 21*e*, and the wiring electrodes connected to electrodes 21*c* and 21*e* are wiring electrodes 20*c* and 20*e*. That is, when a drive waveform is applied to an electrode 21*d*, the voltages shown in FIGS. 8A to 8C corresponds to the voltage difference between the wiring electrode 20*d* and the wiring electrodes 20*c* and 20*e*, which is equal to the voltage difference between the electrode 21*d* and the electrodes 21*c* and 21*e*.

FIG. 8A is an example of the drive waveform 51-7 when 7 droplets are consecutively ejected per dot location. When the drive waveform 51-7 is applied to the electrode 21*d*, when the voltage of the drive waveform 51-7 is 0, the pressure chamber 24*d* is in the state shown in FIG. 5A, and the volume of the pressure chamber 24*d* does not change. When the voltage of the drive waveform 51-7 applied to the electrode 21*d* is V2, the pressure chamber 24*d* is in the state shown in FIG. 5B and the pressure chamber 24*d* expands. Further, when the voltage of the drive waveform 51-7 applied to the electrode 21*d* is −V2, the pressure chamber 24*d* is in the state shown in FIG. 6A, and the pressure chamber 24*d* contracts.

Figure 9:
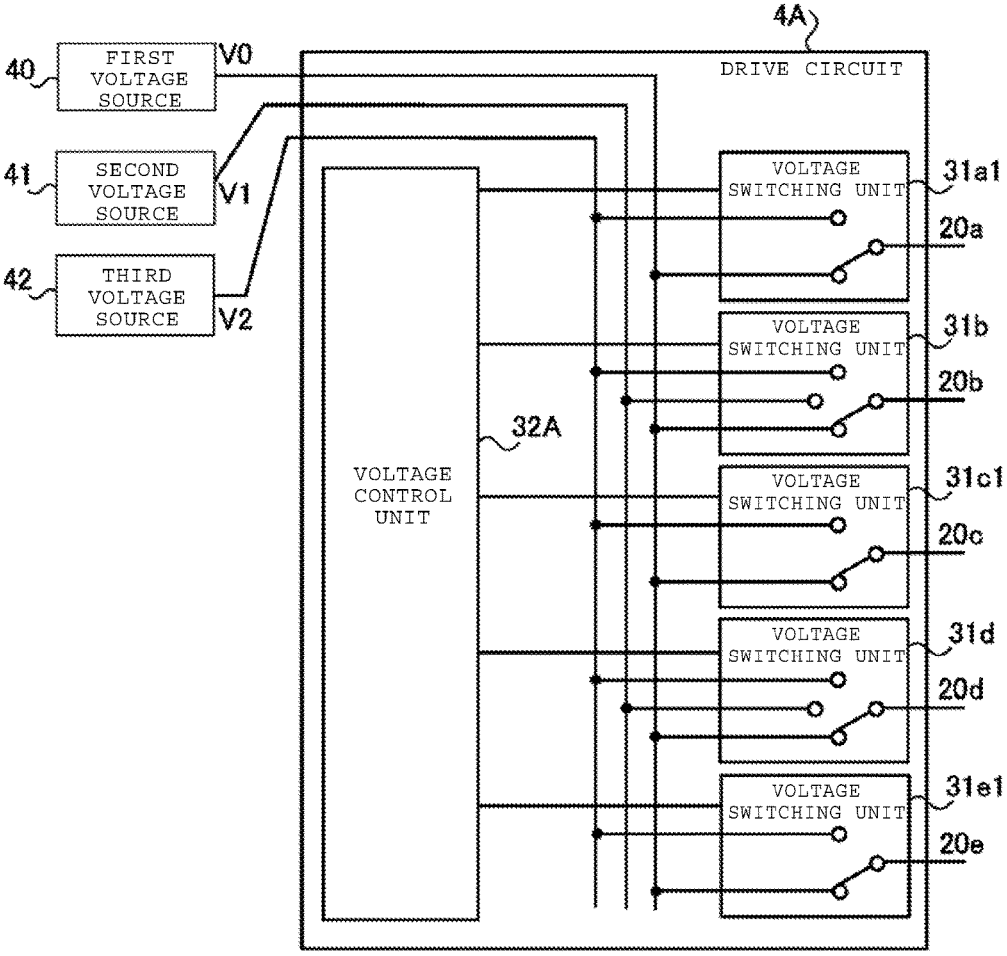
FIG. 9 is a diagram illustrating a second configuration example of a drive circuit.

FIG. 9 is a modification example, also referred to as a second configuration example, of the drive circuit. In the drive circuit 4A shown in FIG. 9, the voltage −V1 is not held. The voltage switching unit is controlled by the voltage control unit 32A. If it is not necessary to hold the state of the voltage −V1 in the drive waveform, it is not necessary to connect the electrodes on the inner wall of the air chambers to the second voltage source 41 of the voltage value V1. In the second example in FIG. 9, voltage switching units 31*a*1, 31*c*1, and 31*e*1 are connected to the electrodes on the inner walls of the air chambers via wiring electrodes, and not connected to the second voltage source 41.

FIG. 8A shows the drive waveform 51-7 when 7 droplets are to be ejected. FIG. 8B is the drive waveform 51-2 when 2 droplets are to be ejected and FIG. 8C is the drive waveform 51-1 when one droplet is to be ejected. Each of the drive waveforms 51-7 and 51-2 includes ejection pulses of a first ejection pulse group G1 having the voltage V2 and an ejection pulse of a second ejection pulse group G2 having the voltage V1. The first ejection pulse group G1 is followed by the second ejection pulse group G2.

In the following description, an "ejection pulse group," for example, the first ejection pulse group and the second ejection pulse group, in some examples may consist of only one pulse rather than a series of pulses. In the drive waveform 51-7 shown in FIG. 8A, only a first ejection pulse of the 7 ejection pulses belongs to the first ejection pulse group G1. The second ejection pulse belongs to the second ejection pulse group G2. In the drive waveform 51-2 shown in FIG. 8B, the first ejection pulse of the two ejection pulses belongs to the first ejection pulse group G1, the second ejection pulse belongs to the second ejection pulse group G2. In the drive waveform 51-1 shown in FIG. 8C, the ejection pulse is only an ejection pulse of the first ejection pulse group G1.

The voltage amplitude of the ejection pulses of the first ejection pulse group G1 is the first voltage amplitude at the voltage V2. The voltage amplitude of the ejection pulses of the second ejection pulse group G2 is the second voltage amplitude at the voltage V1 that is smaller than the first voltage amplitude V2. In FIGS. 8A to 8C, the voltage of the first ejection pulse (the first voltage amplitude V2) is 25 V as an example.

When ink droplets are ejected by the ejection pulses of the first ejection pulse group G1, residual pressure vibration occurs in the pressure chamber to which the drive waveform is applied. Each ejection pulse of the second ejection pulse group G2 is output at the timing at which the residual pressure vibration due to the previous ejection pulse and the next ejection pulse are intensified. The interval between two adjacent ejection pulses is determined according to a half of an acoustic resonance cycle of the ink in the pressure chamber 24, referred to as "AL."

In the example shown in FIGS. 8A to 8C, the pulse width of the ejection pulse of the first ejection pulse group G1 is 1 AL. In addition, a pulse width dp of each ejection pulse of the second ejection pulse group G2 is the same 1 AL as the pulse width of the ejection pulse of the first ejection pulse group G1. The interval between two ejection pulses is 2 AL. The pulse width is the sum of the time for raising the waveform from the reference potential V0 to the voltage of each ejection pulse and the time for maintaining the raised voltage. As an example, AL is about 2.2 ρs. At this time, the rise time and the fall time of each pulse are, for example, about 0.2 μs. The rising and falling times of the pulse correlate with the time constant of the entire circuit including the actuator, as a capacitor, and the internal resistance or wiring resistance of the drive circuit. The time constant indicates the charging time or discharging time required for the voltage change inside the capacitor when the voltage source connected to the capacitor changes.

Residual pressure vibration occurs in the pressure chamber even after an ink droplet is ejected by the last ejection pulse. The residual pressure vibration due to the last ejection pulse affects the next ink ejection by the next drive waveform. Therefore, it is necessary to suppress the residual pressure vibration before the next ink ejection is started by the next drive waveform.

The residual pressure vibration is canceled, for example, by a negative pulse, also referred to as an inflow/outflow suppressing pulse). The negative pulse suppresses liquid inflow or outflow in the nozzle and the pressure chamber. In the drive waveforms shown in FIGS. 8A to 8C, the last downward trapezoidal shaped wave is a negative pulse. The negative pulse has the voltage −V2 as a third voltage amplitude. The negative pulse is applied at the timing at which residual pressure vibration is canceled. In the above example in which the voltage of the ejection pulse of the first ejection pulse group G1 is 25 V and AL is about 2.2 μs, the voltage of the negative pulse is −25 V, and a pulse width cp of the negative pulse is 3.4 μs which is larger than AL. The pulse width of the negative pulse is the sum of the time for dropping the waveform from the reference potential V0 to the voltage of the negative pulse and the time for maintaining the dropped voltage.

In the ink jet recording apparatus according to the first embodiment, by coalescence of the consecutively ejected droplets (7 droplets in the drive waveform 51-7 and 2 droplets in the drive waveform 51-2), a large droplet lands on an object. For example, in the case of the drive waveform 51-7, the ink jet recording apparatus consecutively ejects 7 droplets so that 7 droplet volumes of ink land on the object. In the case of the drive waveform 51-2, the ink jet recording apparatus consecutively ejects 2 droplets of ink so that 2 droplet volumes of ink land on the object. That is, the ink jet recording apparatus according to the first embodiment adjusts the size of a droplet landing on the object by changing the number of the ejection pulses of the second ejection pulse group G2 of the drive waveform. In the first embodiment, the maximum number of droplets to be consecutively ejected is 7. However, the maximum number may be more or less than 7. When the maximum number of droplets to be consecutively ejected is 7, the number of gradations of droplet volume(s) supplied to the object is 8 including the case of complete non-ejection (i.e., the number of droplets to be ejected is "0").

In the ink jet recording apparatus according to the first embodiment, droplets to be consecutively ejected are timed so as to coalesce together during the transit to the object. For the consecutively ejected droplets to coalesce before landing on the object, it is necessary that the last droplet in the series that is ejected to have an ejection speed equal to or higher than the ejection speed of the first droplet in the series. In the ink jet recording apparatus according to the first embodiment, the first voltage amplitude V2 and the second voltage amplitude V1 of the drive waveforms are set so that the last droplet has an ejection speed equal to or higher than that of the first droplet. For example, in the case of the above example where the first voltage amplitude V2 is 25 V, the second voltage amplitude V2 is set to be larger than 14 V in consideration of the stability of the ejection behavior.

According to the first embodiment, the printing speed of the ink jet recording apparatus can be increased. To suppress the temperature rise of the drive circuit 4, it is important to lower the power consumption of the drive circuit, which increases during driving. Due to the nature of a drive circuit that outputs high-frequency signals, the voltage level of the pulse typically has a greater influence on the power consumption than the width of each pulse. The voltage of the ink jet head drive device of the multi-drop system in the related art is the same for all ejection pulses. However, in the first embodiment, the voltage V1 of each ejection pulse of the second ejection pulse group G2 is smaller than the voltage V2 of the ejection pulse of the first ejection pulse group. Thus, the drive circuit 4 of the present embodiment has a lower power consumption as compared to a drive circuit of the related art, in which the voltage V1 and the voltage V2 are equal to each other. As a result, since the temperature rise of the drive circuit is suppressed, the required waiting time for heat dissipation from the drive circuit may be smaller. Since the dot frequency becomes higher, the printing speed of the ink jet recording apparatus of the present embodiment may, in general, be faster.

Second Embodiment

In the first embodiment, the pulse width dp of each ejection pulse of the second ejection pulse group G2 is the same as the pulse width (=AL) of the ejection pulses of the first ejection pulse group G1. However, the pulse width dp does not necessarily have to be the same as the pulse width AL. Hereinafter, an ink jet recording apparatus according to the second embodiment will be described. The device configuration of the ink jet recording apparatus is substantially the same as that according to the first embodiment, so the repeated description may be omitted.

Figure 10A:
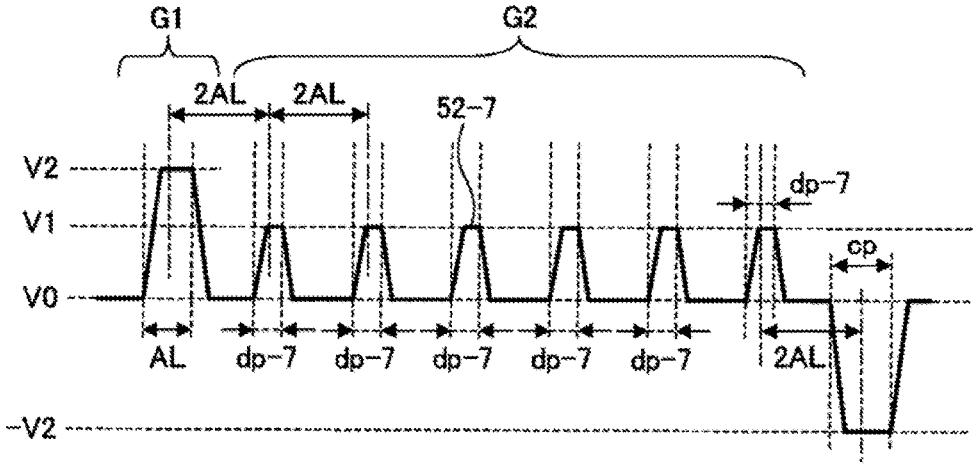
FIG. 10A shows a drive waveform when 7 droplets are consecutively ejected.
Figure 10B:
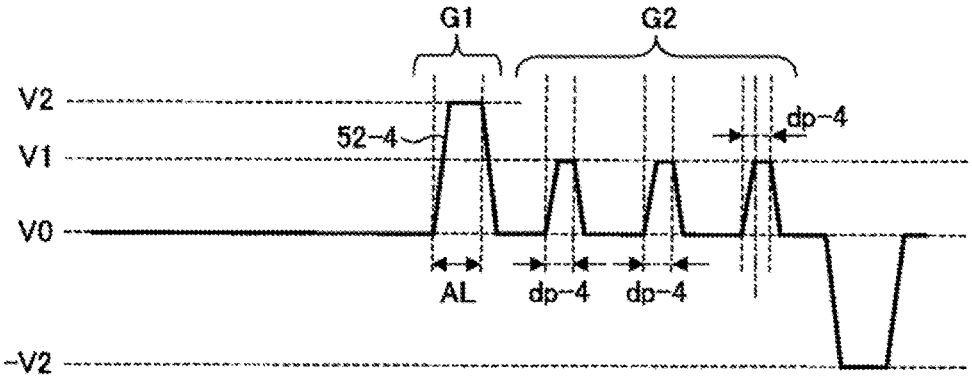
FIG. 10B shows a drive waveform when 4 droplets are consecutively ejected.
Figure 10C:
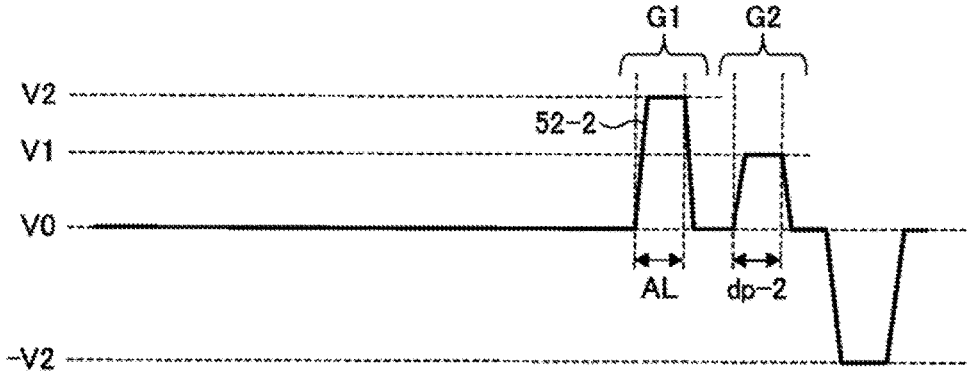
FIG. 10C shows a drive waveform when 2 droplets are consecutively ejected.

FIG. 10A to 10C are examples of a drive waveform of a drive signal in which the pulse width of each ejection pulse of the second ejection pulse group G2 is changed according to the number of droplets being consecutively ejected. FIG. 10A is a drive waveform 52-7 when 7 droplets are consecutively ejected. FIG. 10B is a drive waveform 52-4 when 4 droplets are consecutively ejected. FIG. 10C is a drive waveform 52-2 when 2 droplets are consecutively ejected. The specific illustration of examples of a drive waveform in which the number of droplets is 1, 3, 5, and 6 will be omitted given that these examples may be visualized from the present description.

To stabilize the printing quality, it is desirable that the ejection speed of the droplets after droplet coalescence is constant. The volume of the droplet after droplet coalescence increases in proportion to the number of droplets ejected consecutively. Here, droplet coalescence means that each droplet of the second ejection pulse group G2 is added to a droplet of the first ejection pulse group G1 to form one droplet while transiting to the page or other object. FIG. 11 shows the simulation results illustrating a relationship between the number of droplets being consecutively ejected and ejection speed/ejection volume when the pulse width of each ejection pulse of the second ejection pulse group G2 is varied. The simulation method will be described in more detail below.

A pulse width dp-2 of the ejection pulse of the second ejection pulse group G2 when the number of droplets being ejected is 2 (that it, in the case of FIG. 10C) is the same as the pulse width AL (for example, 2.2 μs) of the ejection pulse of the first ejection pulse group G1. Thus, the drive waveform 51-2 shown in FIG. 8B and the drive waveform 52-2 shown in FIG. 10C are the same drive waveform. Therefore, when the number of droplets is 2, the ejection speed and ejection volume are the same as in the case of the first embodiment.

On the other hand, when the number of droplets being ejected is from 3 to 7, the pulse width of each ejection pulse of the second ejection pulse group G2 is smaller than the pulse width AL of the ejection pulse of the first ejection pulse group G1. In the example of FIG. 11, with respect to the third to seventh droplets, the ejection speed after droplet coalescence becomes substantially constant. In the example of FIG. 11, the ejection speed is approximately 10 m/s, and the ejection volume is substantially proportional to the number of droplets ejected.

As ejection of droplets is repeated, the residual vibration occurring in the pressure chamber and the nozzle surface becomes greater. By changing the pulse width of each ejection pulse of the second ejection pulse group G2 according to the number of droplets being consecutively ejected, it is possible to control so that the ejection speed after droplet coalescence is constant regardless of the number of droplets ejected. In addition, by changing the pulse width of each ejection pulse of the second ejection pulse group G2 according to the number of droplets consecutively ejected, it is possible to control the ejection volume to be proportional to the number of droplets.

Also in the present embodiment, since the voltage V1 of the second ejection pulse group G2 is smaller than the voltage V2 of the first ejection pulse group G1, the power consumption of the drive circuit is suppressed. As a result, since the temperature rise of the drive circuit is suppressed, the waiting time for suppressing the temperature rise of the drive circuit may be reduced. Since the dot frequency can be increased, the printing speed of the ink jet recording apparatus is increased. Moreover, since the pulse width of each ejection pulse of the second ejection pulse group G2 is changed according to the number of droplets, the printing quality is also high.

Third Embodiment

In the first and second embodiments, the pulse width cp of the negative pulse is larger than the pulse width AL of the first ejection pulse. However, the pulse width cp may also be smaller than the pulse width AL. Hereinafter, an ink jet recording apparatus of the third embodiment will be described. The device configuration of the ink jet recording apparatus is substantially the same as that of the first and second embodiments, so the description thereof will be omitted.

Figure 12A:
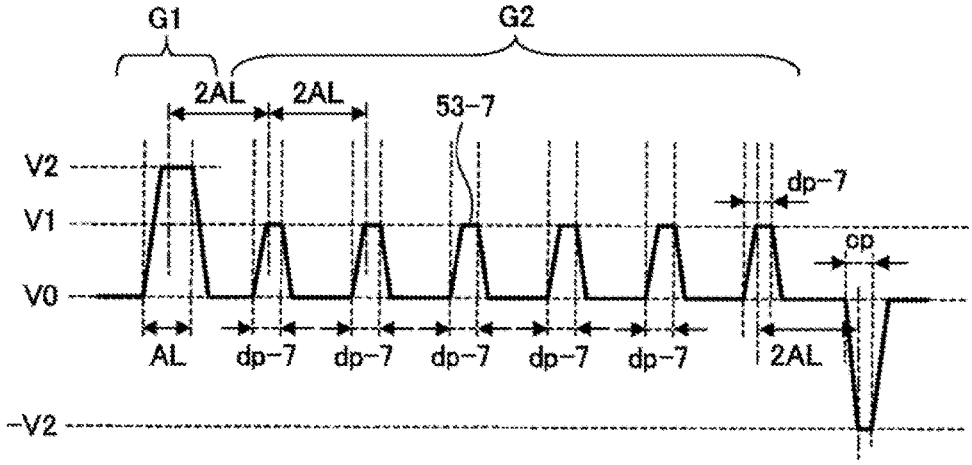
FIG. 12A shows a drive waveform when 7 droplets are consecutively ejected.
Figure 12B:
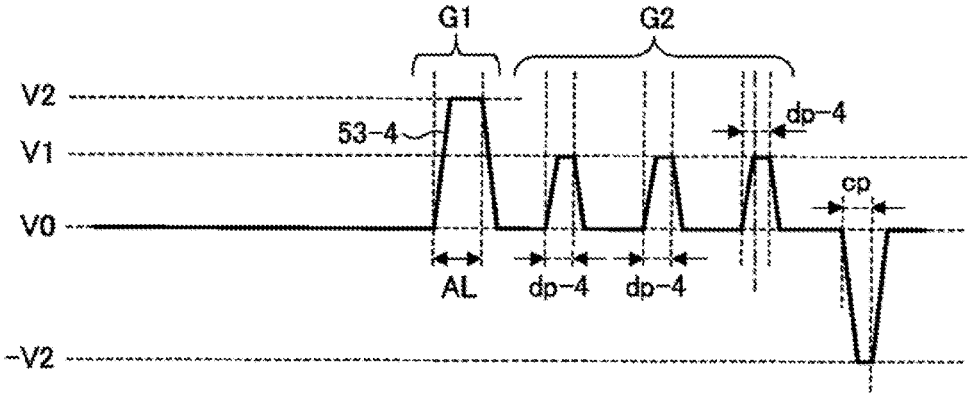
FIG. 12B shows a drive waveform when 4 droplets are consecutively ejected.
Figure 12C:
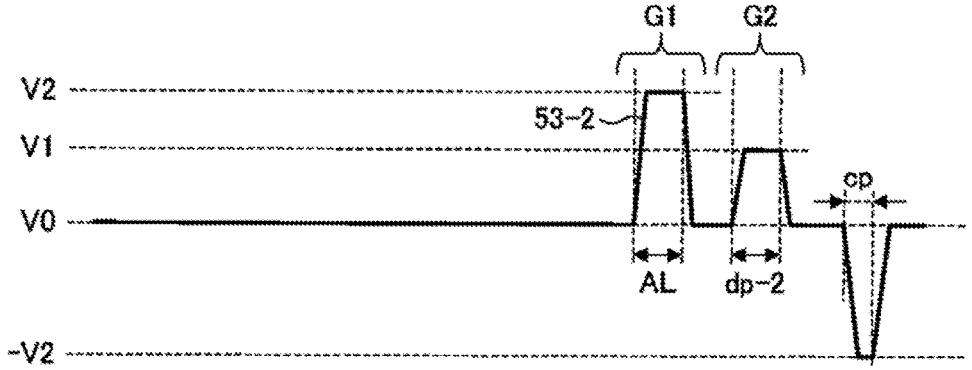
FIG. 12C shows a drive waveform when 2 droplets are consecutively ejected.

FIGS. 12A to 12C are examples of a drive waveform when the pulse width cp of a negative pulse is reduced in the drive waveforms of FIGS. 10A to 10C, respectively. FIG. 12A is a drive waveform 53-7 when 7 droplets are consecutively ejected. FIG. 12B is a drive waveform 53-4 when 4 droplets are consecutively ejected. FIG. 12C is a drive waveform 53-2 when 2 droplets are consecutively ejected. The illustration of an example of a drive waveform in which the number of droplets is 1, 3, 5, and 6 will be omitted.

Figure 13A:
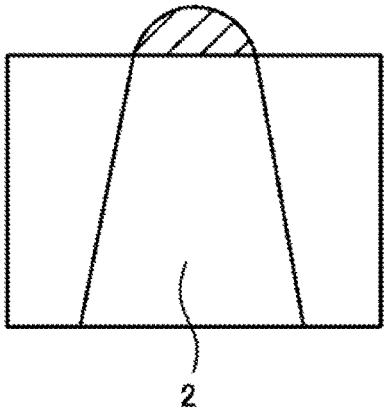
FIG. 13A shows a diagram of a nozzle having a convex meniscus.
Figure 13B:
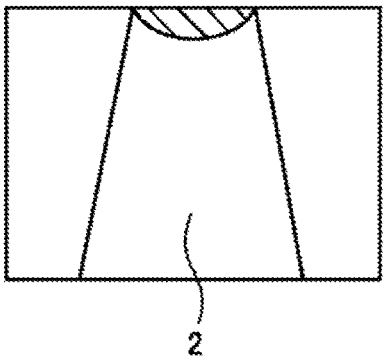
FIG. 13B shows a diagram a nozzle having a concave meniscus.

The pulse width cp of the negative pulse is determined by considering the convex meniscus. FIGS. 13A and 13B are cross-sectional diagrams of a nozzle when the convex meniscus occurs. FIG. 13A shows the nozzle in which the convex meniscus has occurred and FIG. 13B shows the nozzle in which the concave meniscus has occurred. In the third embodiment, the concave meniscus is also treated as one kind of the convex meniscus. In FIG. 13A, the volume of the liquid indicated by the shaded area right above the nozzle opening is the amount of the convex meniscus. In FIG. 13B, the volume of the outside air in the nozzle indicated by the shaded area is the amount of the convex meniscus, and is a negative value.

When the next drive waveform is input while the convex meniscus is large, the volume (in particular, ejection volume) of the droplet ejected by the next drive waveform changes. Thus, it is necessary to consider the amount of the convex meniscus in determining the input timing of the next drive waveform.

Figure 14:
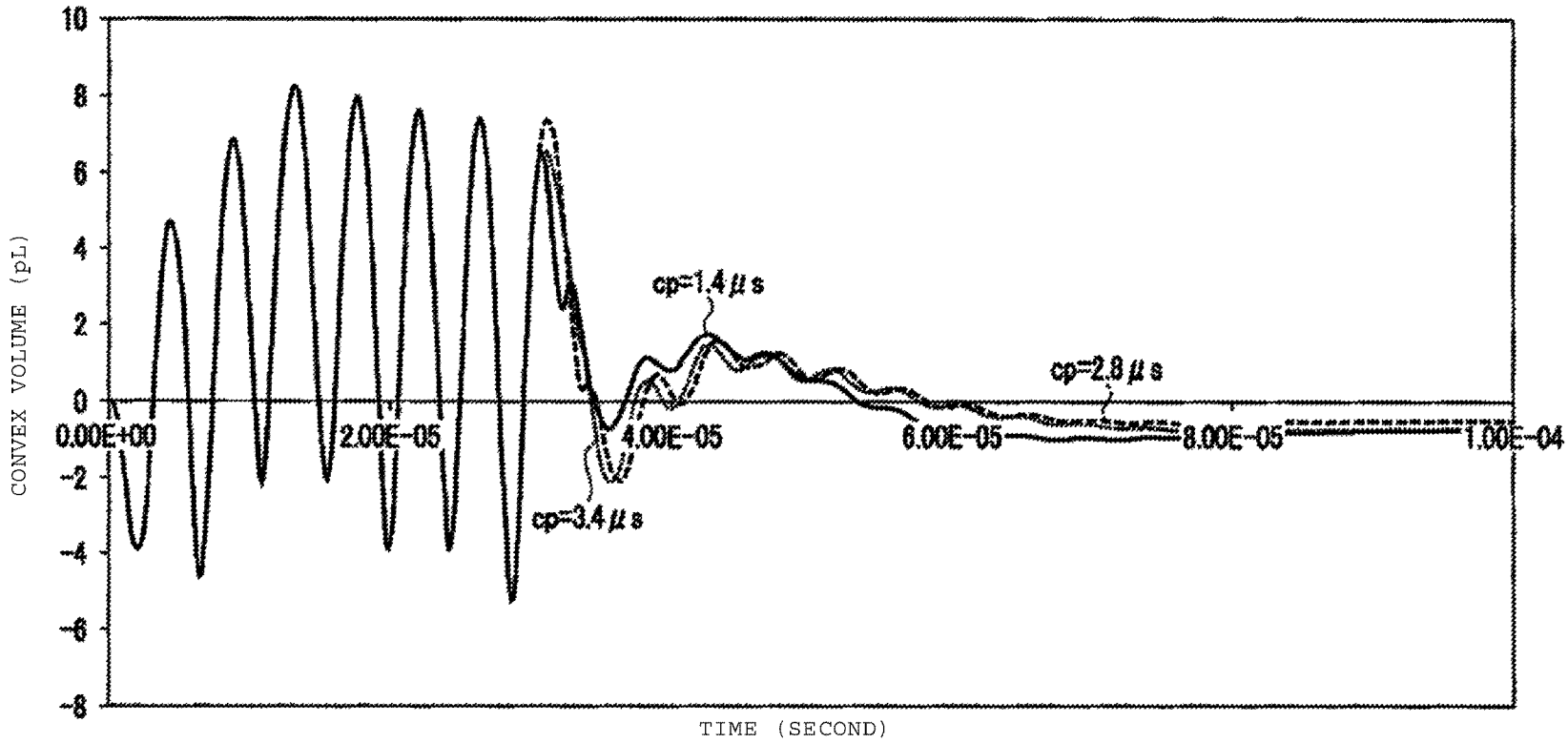
FIG. 14 shows a diagram illustrating temporal changes of a convex meniscus.

FIG. 14 is a diagram showing the temporal change of the amount of the convex meniscus when the pulse width of a negative pulse is changed. When the amount of the convex meniscus is a negative value, it means that the concave meniscus has occurred by the amount corresponding to the volume thereof. FIG. 14 shows an example in which 7 droplets are to be consecutively ejected. The horizontal axis is the elapsed time since inputting a drive waveform and the vertical axis is the amount of the convex meniscus. The vertical axis is the amount of liquid present within 50 μm in the ejection direction from the nozzle plate surface. The pulse width cp of negative pulses has 3 kinds of 1.4 μs, 2.8 μs, and 3.4 μs. Since AL is 2.2 μs, the pulse width cp is smaller than AL only when the pulse width cp is 1.4 μs.

It is 35 μs after inputting the drive waveform that 7 droplets are out of a range of 50 μm from the nozzle plate surface. Therefore, in the graph of FIG. 14, after 35 μs elapsed in the graph, the amount of the convex meniscus after droplet ejection is obtained. When the pulse width of the negative pulse is 1.4 μs, the amount of the convex meniscus becomes the maximum at about 42.5 μs. In addition, the amount of the convex meniscus is minimized at about 70 μs (the timing at which the convex meniscus stabilizes).

When the pulse width cp of the negative pulse is 1.4 μs, the increase/decrease of the amount of the convex meniscus is larger than that when the pulse width cp is 2.8 μs or 3.4 μs. However, when a pulse width cp is 1.4 μs, the timing at which the convex meniscus stabilizes is earlier than in other cases as can be seen from FIG. 14. In this example, it is desirable that the drive circuit starts inputting the next drive waveform after 70 μs from the input start point of the previous drive waveform. However, the timing of input of the next drive waveform may be earlier than 70 μs to increase the printing speed.

As described above, the pulse width cp of the negative pulse shown in FIGS. 10A to 10C is larger than AL. In FIGS. 12A to 12C, the pulse width cp of the negative pulse of each of the drive waveforms 53-7, 53-4, and 53-2 is smaller than AL. As the pulse width cp of the negative pulse decreases, the time of the drive waveform per dot location also decreases. As the length of the drive waveform per dot location decreases, it is possible to shorten the repetition period (dot cycle) of the drive waveform. As a result, it is possible to increase the printing speed of the ink jet recording apparatus.

Fourth Embodiment

To lower the power consumption of the drive circuit, it is desirable to lower the voltage V1 of the second ejection pulse group G2. Here, attention is paid to the simulation result shown in FIG. 11. As described above, FIG. 11 is the simulation results when the voltage V1 of the second ejection pulse group G2 is set to 16 V. In the example of FIG. 11, the ejection speed after droplet coalescence is substantially constant regardless of the number of droplets. In addition, the ejection volume is substantially proportional to the number of droplets. This is substantially an ideal condition.

Here, attention is paid to the results when the number of consecutively ejected droplets is 3 to 7. When the number of consecutively ejected droplets is 3 to 7, the pulse widths are all 1.4 μs or less as can be seen from the table of FIG. 11. The closer the pulse width is to AL, the higher the droplet speed. In the example of FIG. 11, since AL is 2.2 μs, when the number of consecutively ejected droplets is 3 to 7, there is room to increase the pulse width. When the number of consecutively ejected droplets is 3 to 7, there is room for lowering the voltage from 16 V by increasing the pulse width.

Next, attention is paid to the results when the number of consecutively ejected droplets is 2. When the number of consecutively ejected droplets is 2, the pulse width is already 2.2 μs which is the same as AL. That is, when the number of consecutively ejected droplets is 2, there is no room to increase the pulse width. When the number of consecutively ejected droplets is 2, the voltage cannot be lowered from 16 V. When the voltage is lowered from 16 V, when the number of droplets is 2, the ejection power will be insufficient.

In the fourth embodiment, a plurality of ejection pulses are included in the first ejection pulse group G1. That is, an ejection pulse that ejects the second droplet is included in the first ejection pulse group G1 having a higher voltage than the first ejection pulse group G1 having a low voltage. The ejection power of the second droplet is adjusted with the pulse width. In this way, it possible to lower the voltage of the second ejection pulse group G2. Hereinafter, an ink jet recording apparatus of the fourth embodiment will be described. The device configuration of the ink jet recording apparatus is the same as those of the first to third embodiments except that the second voltage source 41 outputs V1' lower than V1.

Figure 15A:
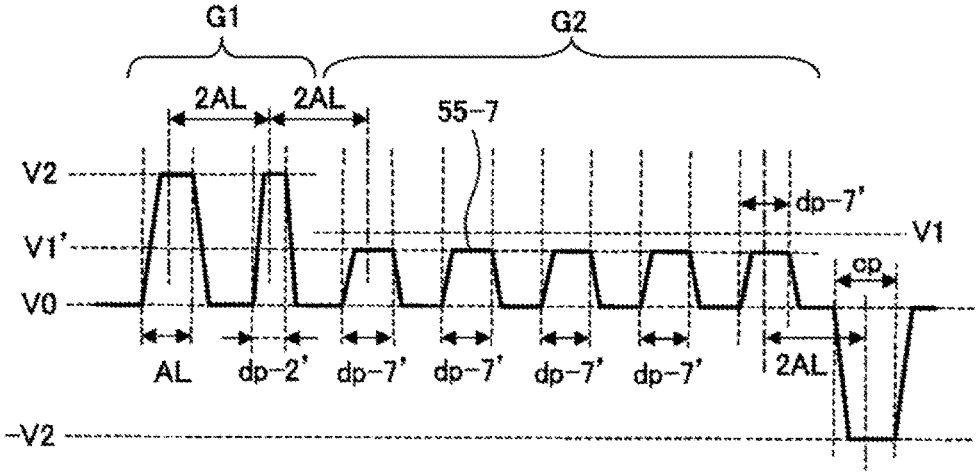
FIG. 15A shows a drive waveform 7 droplets are consecutively ejected.
Figure 15B:
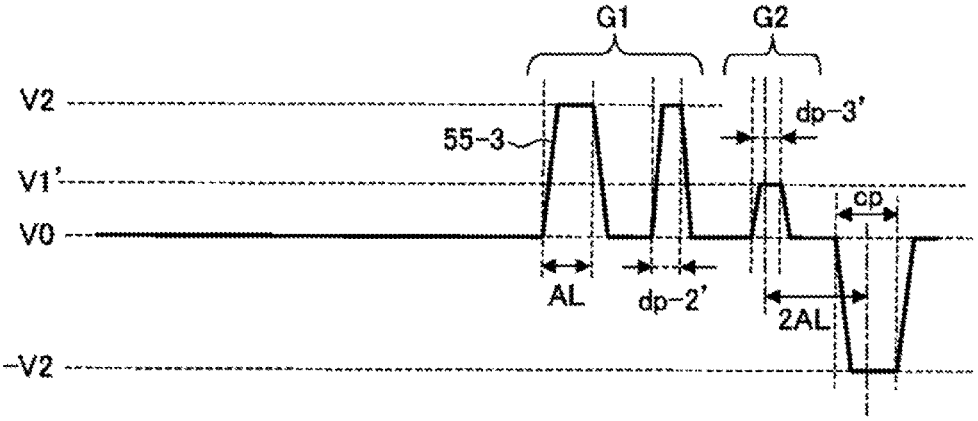
FIG. 15B shows a drive waveform when 3 droplets are consecutively ejected.
Figure 15C:
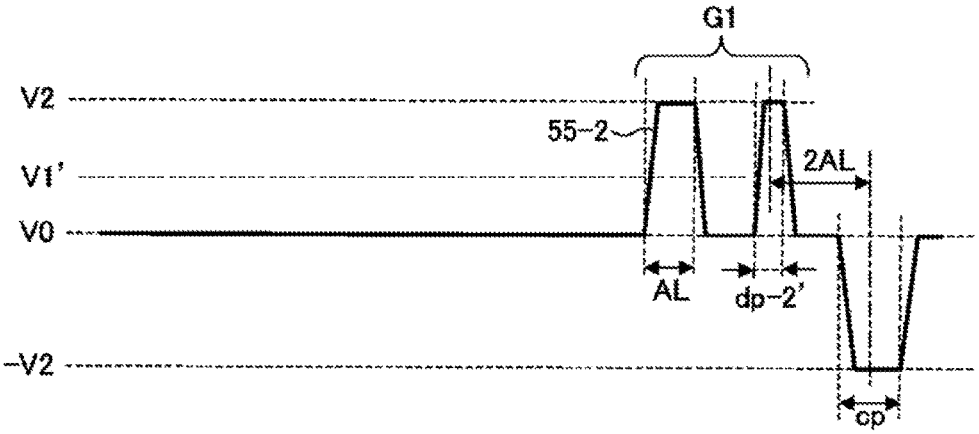
FIG. 15C shows a drive waveform when 2 droplets are consecutively ejected.

FIG. 15A to 15C are diagrams showing the drive waveforms 55 (55-7, 55-3, and 55-1) of the drive signal used in the fourth embodiment. FIG. 15A is a drive waveform 55-7 in a case where 7 droplets are consecutively ejected. FIG. 15B is a drive waveform 55-3 when 3 droplets are consecutively ejected. FIG. 15C is a drive waveform 55-2 when where 2 droplets are consecutively ejected. The illustration of an example of a drive waveform in which the number of droplets is 1, 4 to 6 will be omitted.

As can be seen from FIGS. 15A to 15C, the first ejection pulse group G1 includes two ejection pulses. Both the two ejection pulses of the first ejection pulse group G1 have a voltage of V2. The voltage V2 is, for example, 25 V. The pulse width of a first ejection pulse of the first ejection pulse group G1 is AL. AL is, for example, 2.2 μs. The pulse width of the first ejection pulse group G1 is dp-2' and is the same as AL or less than AL.

In the case of the fourth embodiment, the second ejection pulse group G2 is a pulse group that ejects the third and subsequent droplets. In the drive waveform 55-7 shown in FIG. 15A, the second ejection pulse group G2 includes 5 ejection pulses. In the drive waveform 55-3 shown in FIG. 15B, the second ejection pulse group G2 includes one ejection pulse. In the drive waveform 55-2 shown in FIG. 15C, since all the ejection pulses are included in the first ejection pulse group G1, the second ejection pulse group G2 includes no ejection pulse.

The voltage of the second ejection pulse group G2 is the voltage V1' smaller than the voltage V1 shown in the first to third embodiments. When it is assumed that the voltage V1 of the first to third embodiments is 16 V, the voltage V1' is smaller than 16 V. In addition, the pulse width of the ejection pulses of the second ejection pulse group G2 is changed for each number of droplets. When the number of droplets to be consecutively ejected is 7, the pulse width of each ejection pulse of the second ejection pulse group G2 is dp-7'. When the number of droplets to be consecutively ejected is 3, the pulse width of each ejection pulse of the second ejection pulse group G2 is dp-3'. The pulse width of the ejection pulses of the second ejection pulse group G2 is the same as AL or smaller than AL.

The voltage and the pulse width of the negative pulse are the same as in the second embodiment, but the pulse width may be smaller than AL as described in the third embodiment. However, the pulse width may be the same as or larger than AL. The voltage of the negative pulse may also be changed.

Due to the characteristics of the drive head and ink, residual pressure vibration occurring in the pressure chamber changes. In the examples of FIGS. 15A to 15C, the number of the ejection pulses of the first ejection pulse group G1 is 2. However, depending on the characteristics of the drive head and ink, the number of the ejection pulses of the first ejection pulse group G1 may be 3 or more.

In the case of the drive waveform of the fourth embodiment, in the drive waveform 55-2 ejecting 2 droplets, there is no second ejection pulse group. Therefore, the power consumption of the drive waveforms 51-2, 52-2, and 53-2 shown in the first to third embodiments is smaller. However, in the case of the drive waveform ejecting 3 droplets or more in the second ejection pulse group G2, the voltage V1' of the second ejection pulse group G2 is low. In particular, in the drive waveform 55-7 ejecting 7 drops, since the number of the second ejection pulses is as many as 5, the effect of lowering the voltage of the second ejection pulse group G2 is greatly increased.

EXAMPLE

Hereinafter, results of various simulations using the ink jet recording apparatus of the fourth embodiment are shown. FIGS. 16 to 25 show the results of simulation by numerical analysis. The simulation method is as follows.

First, a simulation operator performs the calculation of the displacement occurring in the actuator. This displacement can be calculated by structural analysis. The fluid flow in the pressure chamber after undergoing displacement by the actuator is calculated by a compressible fluid analysis. The behavior of droplets ejected from the nozzles is calculated by surface fluid analysis.

The scope of the structural analysis will be described with reference to FIG. 4A and FIG. 4B, which includes the piezoelectric member 14 and the nozzle plate 16 that form the pressure chamber 24 in the vertical direction, the piezoelectric member 14 in the left-right direction, and a portion from the A line to the A2 line shown in FIG. 3 in the depth direction (the vertical direction in FIG. 3). The boundary surface having a normal line in the vertical direction in FIG. 3 is set as a symmetrical boundary.

The compressible fluid analysis is performed in a range including the pressure chamber. The boundary between the ink supply path and the ink discharge path and the pressure chamber have a free flowing condition. The pressure value in the vicinity of the nozzle in the pressure chamber is used as an input condition of the surface fluid analysis for analyzing the liquid surface of the nozzle.

Thus, in the surface fluid analysis, the liquid flow rate flowing into the nozzle from the pressure chamber is input to the compressible fluid analysis as the outflow flow rate in the vicinity of the nozzle in the pressure chamber. In this way, the surface fluid analysis and the compressible fluid analysis are performed in relation to each other.

First, the relationship between a pulse width dp-2' of a second ejection pulse of the first ejection pulse group G1 and the droplet speed will be examined.

Figure 17:
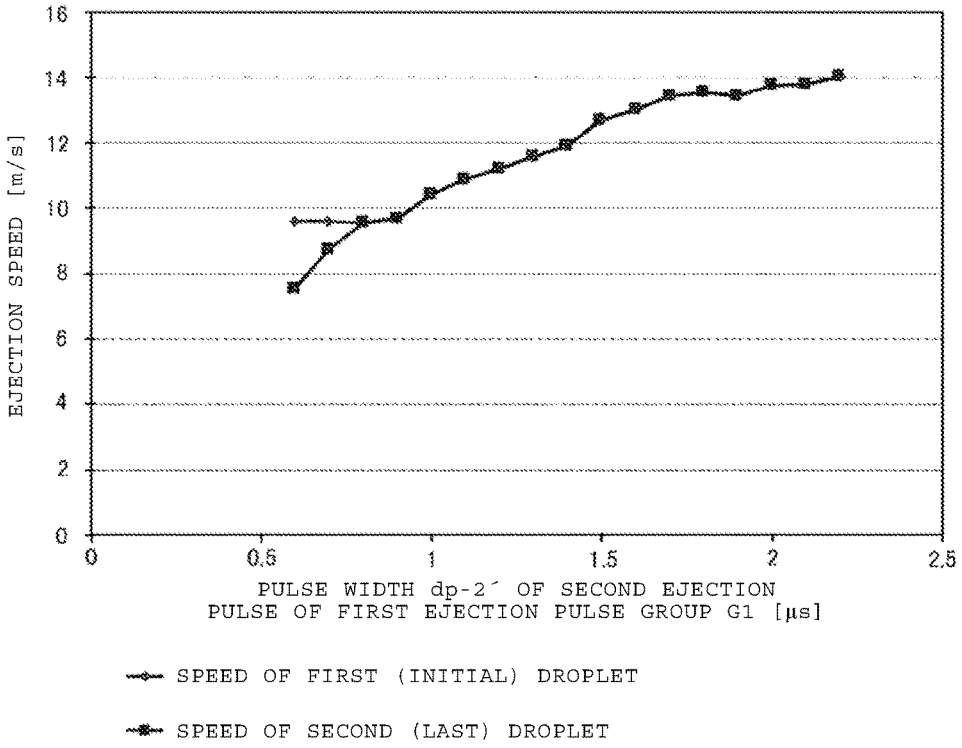
FIG. 17 is a graph illustrating the simulation results of FIG. 16.

FIGS. 16 and 17 are simulation results of the drive waveform 55-2 shown in FIG. 15C. FIG. 16 is simulation results of the droplet speed when the pulse width dp-2' is changed. The simulated droplet speed corresponds to two speeds of the speed of a first droplet ejected by a first ejection pulse of the first ejection pulse group G1, and the speed of a second droplet ejected by the second ejection pulse of the first ejection pulse group G1. FIG. 17 is a graph of the simulation results shown in FIG. 16. AL is 2.2 μs, the pulse interval is 4.4 μs, the voltage V2 of the ejection pulses of the first ejection pulse group G1 is 25 V, the voltage of the negative pulse is −25 V, and the pulse width cp is 3.4 μs.

As can be seen from FIGS. 16 and 17, when the pulse width dp-2' of the second ejection pulse of the first ejection pulse group G1 is 0.8 μs or more, the speeds of the two droplets are equalized. That is, the first droplet and the second droplet coalesce. When the pulse width dp-2' is around 0.8 μs, the speed of the second droplet increases as the pulse width dp-2' increases. That is, the ejection behavior is stable. Therefore, in the present example, it is assumed that the pulse width dp-2' is 0.8 μs.

Next, the relationship between the pulse widths of the ejection pulses of the second ejection pulse group G2 and the droplet speed will be examined.

Figure 19:
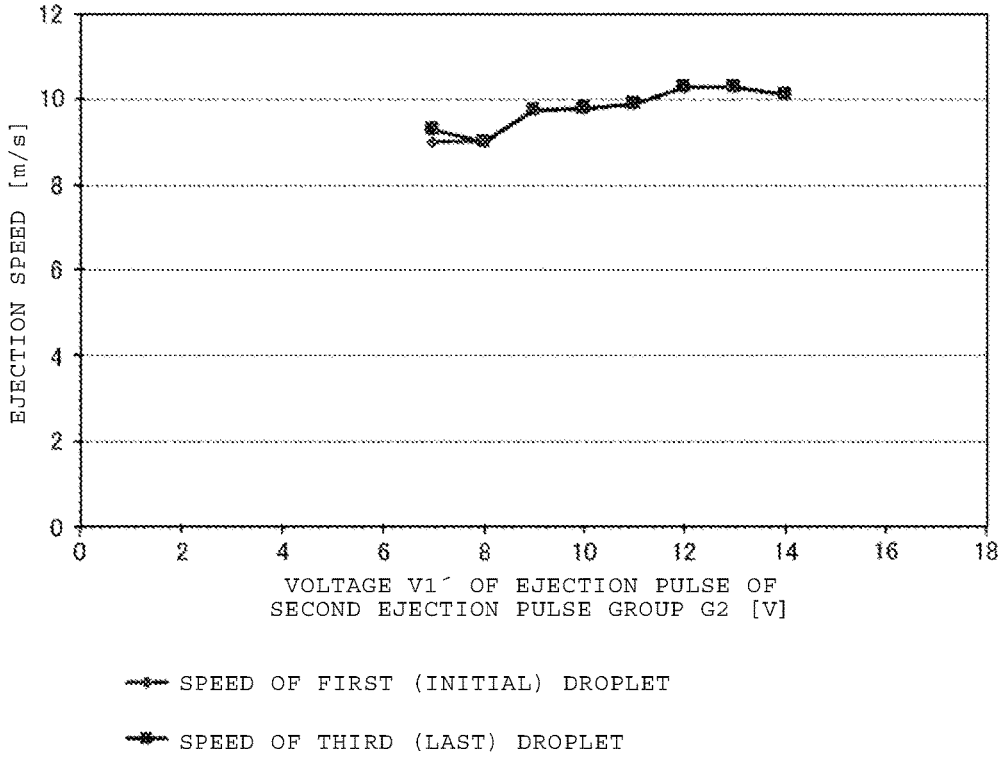
FIG. 19 is a graph illustrating the simulation results of FIG. 18.

FIGS. 18 and 19 are simulation results of the drive waveform 55-3 shown in FIG. 15B. FIG. 18 shows simulation results illustrating a droplet speed when the voltage V1' of the ejection pulses of the second ejection pulse group G2 is changed. The simulated droplet speed corresponds to two speeds of the speed of the first droplet ejected by the first ejection pulse of the first ejection pulse group G1, and the speed of a third droplet ejected by a first ejection pulse of the second ejection pulse group G2. FIG. 19 is a graph of the simulation results shown in FIG. 18. AL is 2.2 μs, the pulse interval is 4.4 μs, the voltage V2 is 25 V, the pulse width dp-2' is 0.8 μs, the voltage of the negative pulse is −25 V, and the pulse width cp is 3.4 μs. A pulse width dp-3' of the ejection pulse of the second ejection pulse group G2 is 2.2 μs.

As can be seen from FIGS. 18 and 19, when the voltage is 8 V or more, the speed of the first droplet and the speed of the third droplet (the last droplet) are the same. That is, when the number of droplets to be consecutively ejected is 3, all droplets to be consecutively ejected coalesce at a voltage of 8 V or more.

Figure 21:
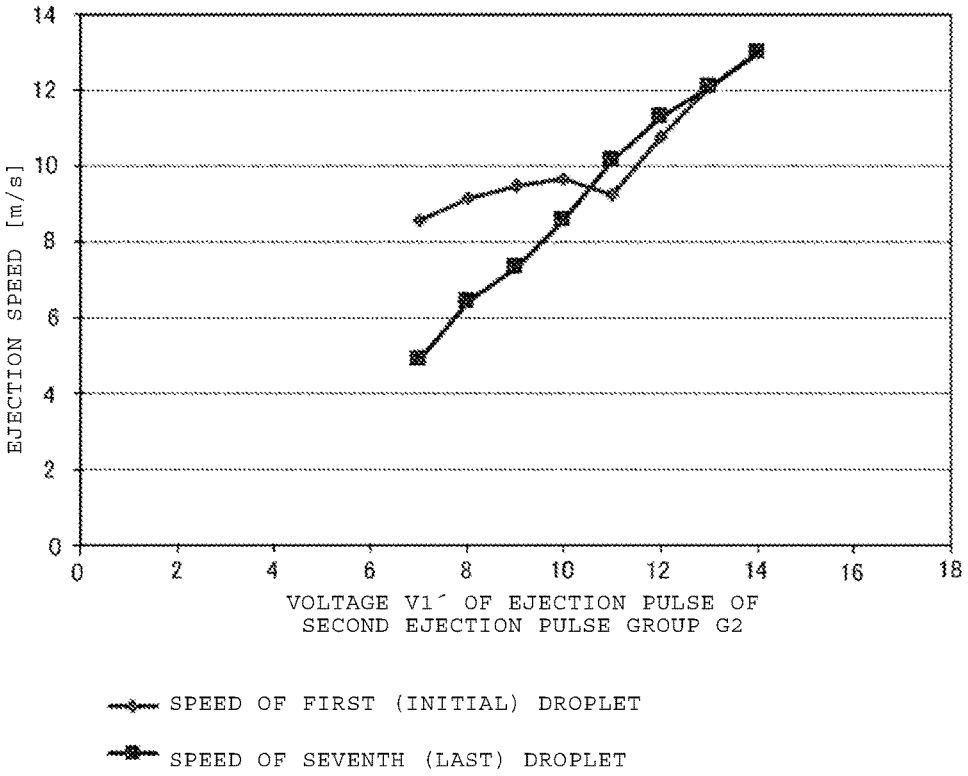
FIG. 21 is a graph illustrating the simulation result of FIG. 20.

FIGS. 20 and 21 are simulation results of the drive waveform 55-7 shown in FIG. 15A. FIG. 20 shows simulation results illustrating droplet speeds when the voltage V1' of the ejection pulses of the second ejection pulse group G2 is changed. The simulated droplet speed corresponds to two speeds of the speed of the first droplet ejected by the first ejection pulse of the first ejection pulse group G1, and the speed of a seventh droplet ejected by the last ejection pulse of the second ejection pulse group G2. FIG. 21 is a graph of the simulation results shown in FIG. 20. AL is 2.2 μs, the pulse interval is 4.4 μs, the voltage V2 is 25 V, the pulse width dp-2' is 0.8 μs, the voltage of the negative pulse is −25 V, and the pulse width cp is 3.4 μs. The pulse width dp-7' of the ejection pulses of the second ejection pulse group G2 is 2.2 μs.

As can be seen from FIGS. 20 and 21, when the voltage is 11 V or more, the speed of the seventh droplet is higher than the speed of the first droplet. The speed of the seventh droplet increases as the voltage increases, thereby indicating that the ejection behavior is stable. From the results of FIGS. 18 to 21, it is desirable that the voltage V1' of the second ejection pulse group G2 is 11 V.

Figure 23:
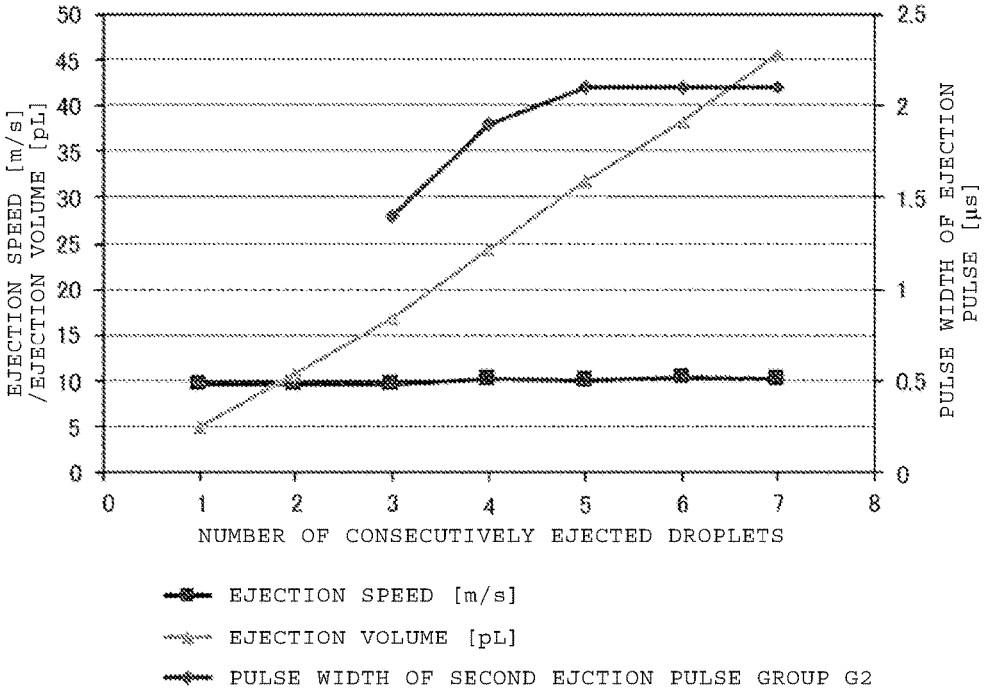
FIG. 23 is a graph illustrating the simulation result of FIG. 22.

Next, an ejection simulation is performed with the pulse width dp-2' of the second ejection pulse of the first ejection pulse group G1 set to 0.8 μs and the voltage V1' of the second ejection pulse group G2 set to 11 V. FIG. 22 and FIG. 23 are simulation results.

FIG. 22 shows a relationship between the number of droplets to be consecutively ejected, the ejection speed, and the ejection volume. The "pulse widths of the second ejection pulse group" in the table show the minimum value of the pulse width at which the droplet speed by the last ejection pulse is larger than the droplet speed by the first ejection pulse. The ejection speed and ejection volume in the table have the values at that time. FIG. 23 is a graph of the simulation results shown in FIG. 22. AL is 2.2 μs, the pulse interval is 4.4 μs, the voltage V2 is 25 V, the pulse width dp-2' is 0.8 μs, the voltage of the negative pulse is −25 V, and the pulse width cp is 3.4 μs. As described above, the voltage V1' is 11 V.

As can be seen by comparing the results of FIG. 22 with the results of the second embodiment shown in FIG. 11, the pulse width of each ejection pulse of the second ejection pulse group G2 of the present example is larger than the pulse width of each ejection pulse of the second ejection pulse group G2 of the second embodiment. This is because that the voltage of the second ejection pulse group is lowered from 16 V to 11 V. Thus, each ejection pulse of the second ejection pulse group G2 can effectively use the pulse width.

Referring to FIG. 23, as the number of consecutively ejected droplets increases, the pulse width of each ejection pulse of the second ejection pulse group G2 increases. Here, it is necessary to set the number of consecutively ejected droplets to 8 or more depending on the circumstances of design or the like. Even if the pulse width of the second ejection pulse G2 is the maximum AL, it is assumed that the speed of the last droplet by the last ejection pulse is not greater than the speed of the first droplet by the first ejection pulse. In this case, the voltage of the last ejection pulse may be higher than the voltage V1' of the second ejection pulse group. For example, the voltage of the last ejection pulse may be the same as the voltage V2, which is 25 V in the present example, of the first ejection pulse. Then, the pulse width of the last ejection pulse may be adjusted so that the speed of the last droplet is greater than the speed of the first droplet.

Next, the difference between the power consumption by the drive waveform of the fourth embodiment and the power consumption by the drive waveform of the second embodiment will be examined.

An energy consumption model of the ink jet head is considered in examining differences in energy consumption. First, an actuator of a pressure chamber is regarded as a capacitor. Then, a resistor is connected in series to the capacitor. It is assumed that the resistor consumes energy when droplets are ejected. Such an RC series circuit including the capacitor and the resistor is a simplified energy consumption model of the ink jet head for the simulation.

The energy consumed by the voltage source when a voltage is applied from the voltage source to the actuator is proportional to an electrostatic capacitance C of the actuator and proportional to the square of the voltage applied to the actuator. When the ink jet head is the same and only the drive waveform is different, the electrostatic capacitance C is the same. Therefore, in considering the difference in power consumption, it is sufficient to consider only the number of rectangular waves of the drive waveform and the voltage of the rectangular wave.

The difference P between the power consumption by the drive waveform of the fourth embodiment shown in FIGS. 15A to 15C and the power consumption by the drive waveform of the second embodiment shown in FIGS. 10A to 10C is expressed by Equation (1):

$$P=(N-M(N))\times(V1^2-V1'^2)-(M(N)-1)\times(V2^2-V1^2)$$

Here, N is the number of consecutively ejected droplets, M(N) is the number of ejection pulses of the first an ejection pulse G1, V1 is a voltage of the second ejection pulse group G2 of the drive waveform of the second embodiment, V1' is a voltage of the second an ejection pulse G2 of the drive waveform of the fourth embodiment, and V2 is a voltage of the first an ejection pulse G1. In the case of the drive waveform shown in FIG. 15, M(N) is 1 when N is 1 and M(N) is 2 when N is 2 or more. If P is a positive value, the drive waveform of the fourth embodiment has lower power consumption than the drive waveform of the second embodiment.

Here, the difference P in power consumption is considered by substituting a specific value to Equation (1). As the number of droplets per dot location increases, the power consumption per dot location increases and the temperature of the drive circuit tends to rise. Therefore, the result for N as 7, which is the maximum number of droplets of the second embodiment, is compared with the second and fourth embodiments. The voltage of the second ejection pulse group G2, V1', in the fourth embodiment, for which the Equation (1) becomes zero or more when M(7) is 2, V2 is 25 V, and V1 is 16 V is about 13.49 V or less. In the present example, since the voltage difference of the second ejection pulse is 11 V, it can be seen that in the case of the waveform of the number of droplets 7, the power consumption of the drive waveform of the present example is lower than that of the drive waveform of the second embodiment.

Next, the pulse width cp of the negative pulse will be examined.

Manufacturing variation inevitably exists in each nozzle of the ink jet head. In the case of a drive signal having a large increase/decrease in the convex meniscus, variations in the meniscus behavior due to the manufacturing variation also increase. For this reason, the pulse width of the negative pulse may need to be adjusted for each nozzle. However, the ink jet head drive device according to the example embodiments applies a voltage of V2 to the air chambers on both sides adjacent to the pressure chamber by the negative pulse. The air chambers on both sides are also adjacent to the pressure chambers of the nozzles on both sides of the corresponding nozzle. Thus, there is a restriction to the time adjustment of the negative pulse for each nozzle.

For example, in FIG. 6A, to set the voltage of the electrode 21*d* to −V2, the voltage V2 is applied to the adjacent electrodes 21*c* and 21*e*. "The voltage of the electrode 21*d*" refers to a voltage based on the voltage of the electrode of the adjacent air chamber. Here, setting the voltage of the electrode 21*b* to 0 and −V2 while keeping the voltage of the electrode 21*d* at −V2 in FIG. 6A will be considered. As in the case of the electrode 21*d*, "the voltage of the electrode 21*b*" refers to a voltage based on the voltage of the electrode of the adjacent air chamber.

First, consideration is given to setting the voltage of the electrode 21*b* to 0. To set the voltage of the electrode 21*b* to 0, a voltage of V2 is applied to the electrode 21*b*. In this way, since the potential difference between the electrodes 21*b* and the surrounding electrodes becomes zero, the voltage of the electrode 21*b* becomes zero.

Next, consideration is given to setting the voltage of the electrode 21*b* to −V2 when a negative pulse is applied to the electrode 21*b*. To set the voltage of the electrode 21*b* to −V2, a voltage of 0 is applied to the electrode 21*b*. In this way, since the potential difference between the electrodes 21*b* and the surrounding electrodes becomes −V2, the voltage of the electrode 21*b* becomes −V2. However, in this case, to set the voltage of the electrode 21*b* to V2, when the ejection pulses of the first ejection pulse group G1 are applied to the electrode 21*b*, it is necessary to apply twice the voltage of V2 to the electrode 21*b* as the electrode around the electrode 21*b* is V2. Thus, a new voltage source capable of outputting twice the voltage of V2 is required.

In addition, the drive circuit 4 of the configuration shown in FIG. 7 cannot operate at the same time to apply the voltage −V2 to one of the adjacent nozzles and apply the voltage V2 to the other. There is a restriction to the time adjustment of the negative pulse for each nozzle. Therefore, it is not necessary to individually adjust a negative pulse at each nozzle and it is only required that the increase/decrease of the convex meniscus after droplet ejection is small.

Figure 25:
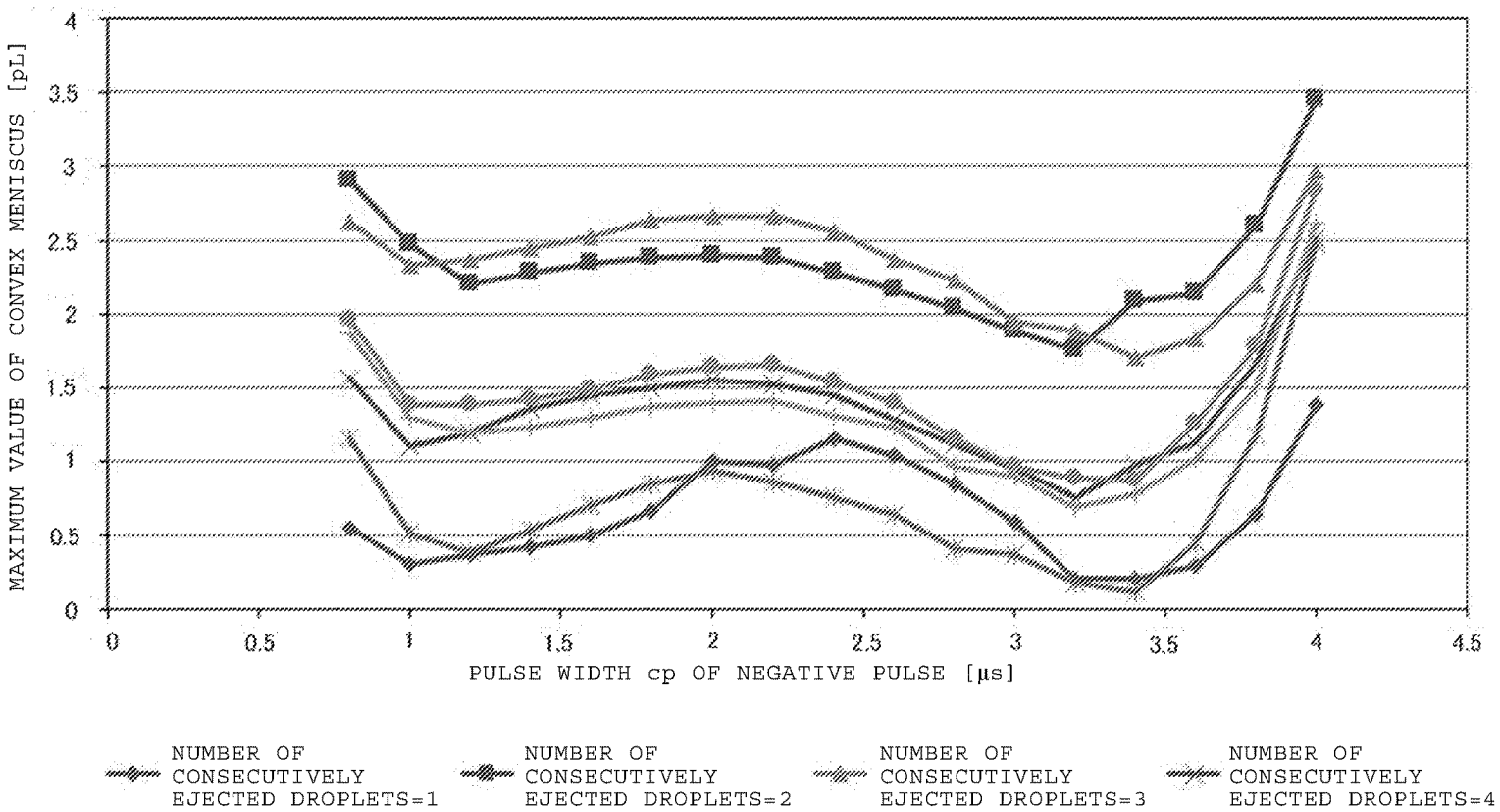
FIG. 25 is a graph illustrating the simulation result of FIG. 24.

FIG. 24 is a diagram showing the maximum value of the convex meniscus when the number of consecutively ejected droplets and the pulse width cp of the negative pulse are changed in the drive waveform of the fourth embodiment. FIG. 25 is a graph of the values shown in FIG. 24. FIGS. 24 and 25 show the change of the maximum value of the convex meniscus when the pulse width of the negative pulse of the drive waveform is set to various values from 0.8 μs to 4 μs for each number of consecutively ejected droplets. AL is 2.2 μs, the pulse interval is 4.4 μs, the voltage V2 of the first ejection pulse group G1 is 25 V, and the voltage V1' of the second ejection pulse group G2 is 11 V. The pulse width of the second ejection pulse group G2 for each number of consecutively ejected droplets is 0.8 μs. According to FIGS. 24 and 25, regardless of the number of droplets to be consecutively ejected, the pulse width cp of the negative pulse where the amount of the convex meniscus is the smallest is equal to greater than AL.

Figures 26, 27:
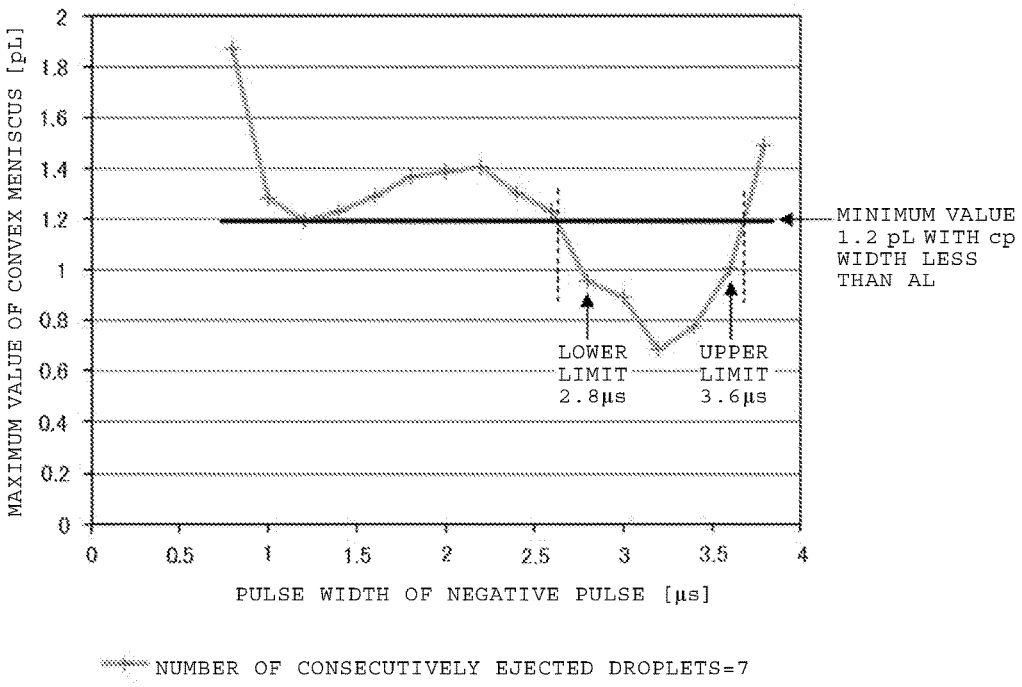
FIG. 26 is a diagram of a relationship between a pulse width of a negative pulse and a maximum value of a convex meniscus.
FIG. 27 shows ranges of a pulse width of a negative pulse.

FIG. 26 is a diagram showing the relationship between the pulse width cp of the negative pulse and the maximum value of the convex meniscus in the drive waveform 55-7 when the number of consecutively ejected droplets is 7. As can be seen from FIG. 26, the pulse width cp is smaller than the minimum value (=1.2 pL) of the amount of the convex meniscus with the cp width less than AL in a certain range above AL. FIG. 27 is a diagram summarizing ranges in which the pulse width cp is smaller than the minimum value of the amount of the convex meniscus with the cp width less than AL in a range where the cp width of the negative pulse is AL or more. As can be seen from FIG. 27, if the pulse width of the negative pulse is set to a value equal to or greater than AL, the amount of the convex meniscus after droplet ejection can be reduced.

As described above, by setting the pulse width of the negative pulse to a value equal to or greater than AL, the amount of the convex meniscus after droplet ejection can be reduced. The ink jet head drive device can improve the printing quality by reducing the amount of the convex meniscus after droplet ejection.

MODIFICATION EXAMPLE

Next, modification examples of the first through fourth embodiments will be described.

Figure 28:
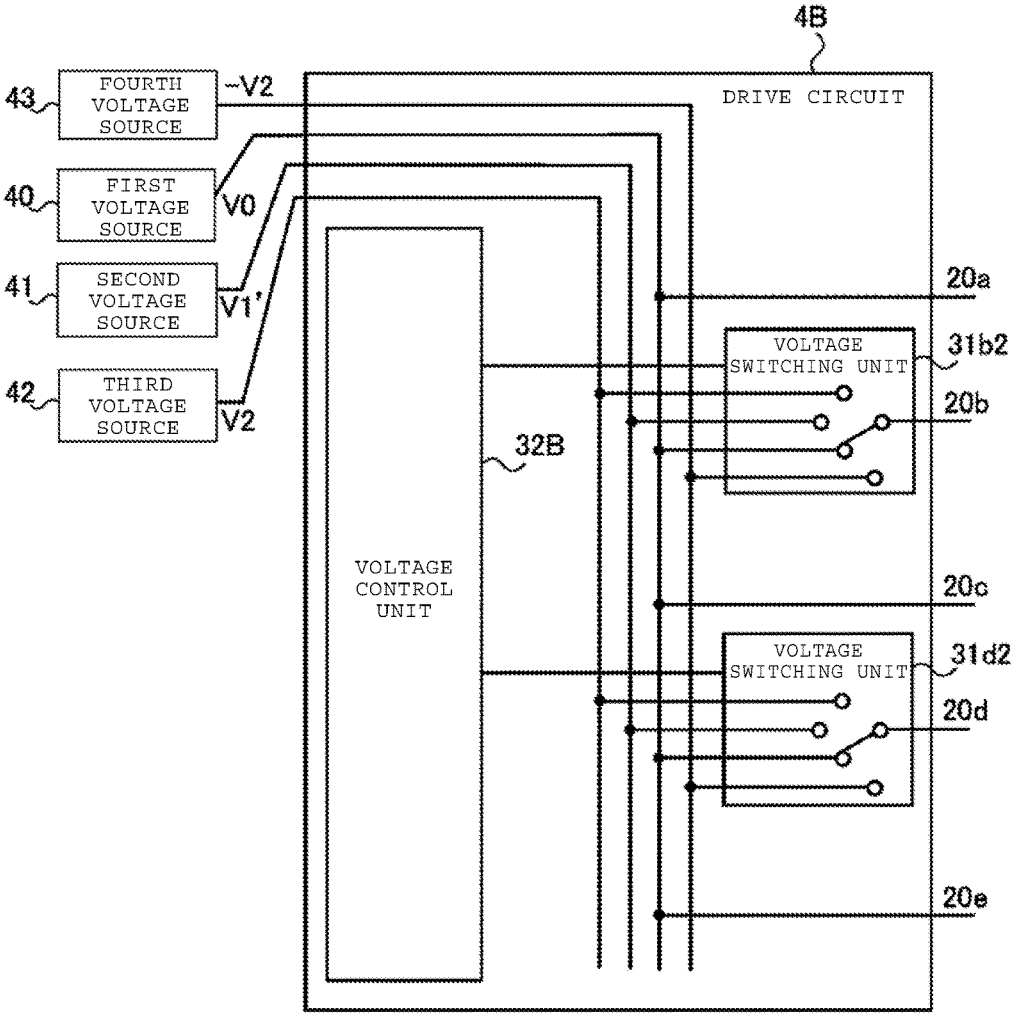
FIG. 28 shows a drive circuit according to a third embodiment.

FIG. 28 is a diagram showing an example of the drive circuit of the drive circuit 4B according to the third embodiment applicable to the above-described example of the ink jet recording apparatus. As shown in FIG. 28, the drive circuit 4B is connected to 4 kinds of voltage sources, the first voltage source 40, the second voltage source 41, the third voltage source 42, and the fourth voltage source 43. The voltage value of the fourth voltage source 43 is −V2. The fourth voltage source 43 provides the third voltage amplitude used in the negative pulse.

The drive circuit 4B includes a voltage switching unit, the number of which is equal to the number of pressure chambers inside the head. However, for simplicity, in FIG. 28, only the voltage switching units up to 31*b*2 and 31*d*2 are shown. Voltage switching units 31*b*2, 31*d*2 connects the wiring electrodes 20*b* and 20*d* with one of the first to fourth voltage sources 40, 41, 42, and 43 which are controlled by a voltage control unit 32B. The wiring electrode 20*b* and 20*d* are connected to the electrodes 21*b* and 21*d* on the inner walls of the pressure chamber. The electrodes 21*a*, 21*c*, 21*e* on the inner walls of the air chamber are connected to the first voltage source 40 via the wiring electrodes 20*a*, 20*c*, and 20*e*.

In the example of FIG. 28, the wiring electrode connected to the electrode on the inner wall of the air chamber is connected to the first voltage source 40 inside the drive circuit 4B. However, the wiring electrode may be connected to the first voltage source 40 outside the drive circuit. In this case, only the wiring electrode connected to the electrode on the inner wall of the pressure chamber is connected to the wiring circuit connected to the drive circuit.

When a negative pulse is input to the nozzle 2*d* shown in FIG. 6B, the drive circuit 4B applies a voltage of −V2 to the electrode 21*d* as shown in FIG. 6B. That is, the drive circuit 4B can adjust not only the ejection pulse but also the pulse width of the negative pulse for each nozzle. Since the drive circuit 4B can adjust the negative pulse for each nozzle, it is possible to advance the start time of the ejection pulses of the first ejection pulse group G1 when the number of droplets to be ejected consecutively is smaller than the maximum number.

Figure 29A:
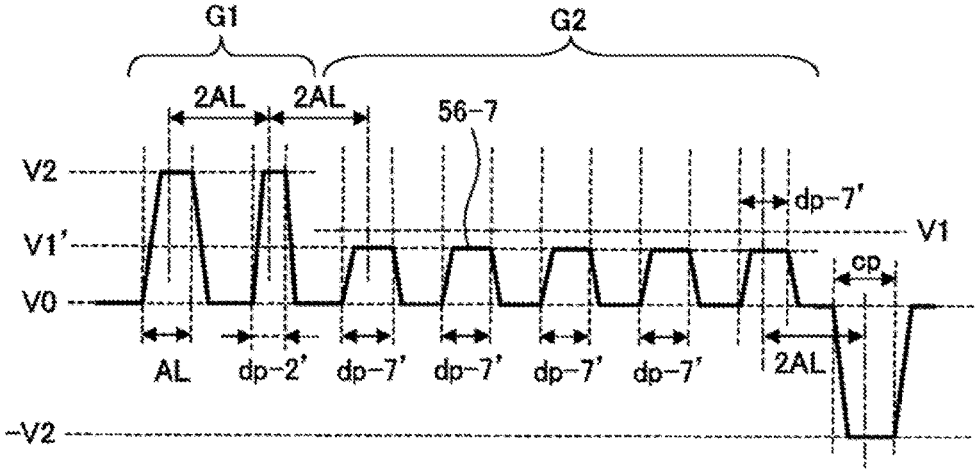
FIG. 29A shows a drive waveform when 7 droplets are consecutively ejected.
Figure 29B:
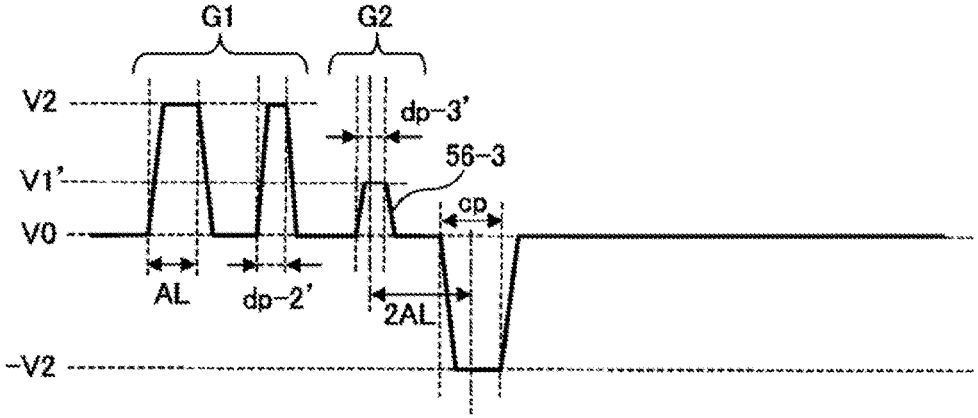
FIG. 29B shows a drive waveform when 3 droplets are consecutively ejected.
Figure 29C:
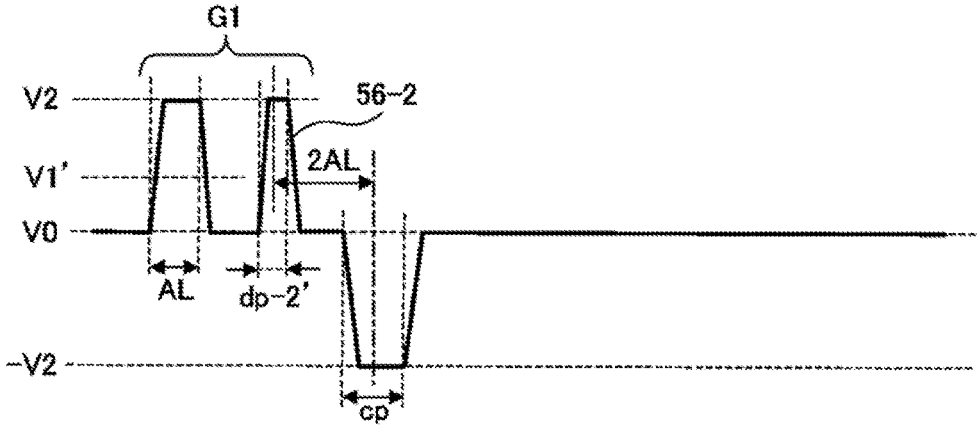
FIG. 29C shows a drive waveform when 2 droplets are consecutively ejected.

FIG. 29A to 29C are diagrams showing the drive waveforms 56-7, 56-3, and 56-2 of the drive signals output by the drive circuit 4B. FIG. 29A shows the drive waveform 56-7 when the number of droplets to be consecutively ejected is 7, which is the maximum number. FIG. 29B shows the drive waveform 56-3 when the number of droplets to be ejected consecutively is 3, which is smaller than the maximum number. FIG. 29C shows the drive waveform 56-2 when the number of droplets to be consecutively ejected is 2, which is smaller than the maximum number. The illustration of an example of a driving waveform in which the number of droplets is 1, 4 to 6 will be omitted.

As shown in FIG. 29B or 29C, when the number of droplets to be consecutively ejected is less than the maximum number, the drive circuit 4B can advance the start time of the ejection pulses of the first ejection pulse group G1. By advancing the start time of the first ejection pulse group G1, it is possible to lengthen the time to the input of the next drive waveform after inputting the negative pulse. For example, in the examples of FIGS. 24 and 25, the amount of the convex meniscus is the largest when the number of droplets to be consecutively ejected is 3. If the number of droplets to be consecutively ejected is "3", the drive circuit 4B can advance the start time of the first ejection pulse by the time corresponding to the maximum "7−3=4" pulses.

As the time to the input of the next drive waveform after outputting the negative pulse becomes longer, the convex meniscus is suppressed more. If the convex meniscus is suppressed, it is possible to reduce the influence on the ejection volume in the next droplet ejection. Thus, as the inkjet recording apparatus, printing quality can be improved.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head drive device, comprising:

an actuator configured to change a pressure on a liquid in a pressure chamber by changing a volume of the pressure chamber in response to a drive signal;

a nozzle plate including a nozzle connected to the pressure chamber and through which the liquid contained in the pressure chamber is ejected when an ejection pulse is supplied to the actuator; and a drive circuit configured to output the drive signal to the actuator as a drive waveform having a first pulse group and a second pulse group following the first pulse group when at least three consecutive ejection pulses are included in the drive waveform, wherein all ejection pulses in the first pulse group have a first voltage amplitude, all ejection pulses in the second pulse group have a second voltage amplitude that is smaller than the first voltage amplitude, and the second voltage amplitude, when supplied to the actuator, causes a droplet ejected by a last ejection pulse in the second pulse group to travel at a speed that is equal to or higher than a speed of a droplet ejected by a first ejection pulse in the first pulse group.

2. The ink jet head drive device according to claim 1, further comprising:

a switch connected to at least three voltage sources, each voltage source supplying a voltage with a different voltage amplitude, wherein the drive circuit controls the switch to connect one of the at least three voltage sources to the actuator.

3. The ink jet head drive device according to claim 1, wherein the drive circuit sets:

a pulse width of a first ejection pulse in the drive waveform as one half of an acoustic resonance cycle of the liquid in the pressure chamber, a pulse width of all remaining ejection pulses in the drive waveform as one half of the acoustic resonance cycle or less, and an interval between centers of two adjacent pulses in the drive signal as the acoustic resonance cycle.

4. The ink jet head drive device according to claim 3, wherein the drive circuit varies pulse width of ejection pulses in the second pulse group based on a number of droplets of liquid being consecutively ejected from the nozzle.

5. The ink jet head drive device according to claim 1, wherein the drive circuit is further configured to supply a negative pulse as the drive signal after the second pulse group of the drive waveform has been supplied to the actuator, the negative pulse having a voltage amplitude opposite in polarity to the first and second voltage amplitudes.

6. The ink jet head drive device according to claim 5, wherein the drive circuit sets a pulse width of the negative pulse as one half of an acoustic resonance cycle or more.

7. The ink jet head drive device according to claim 5, wherein the drive circuit sets a pulse width of the negative pulse as one half of an acoustic resonance cycle or less.

8. The ink jet head drive device according to claim 1, wherein the first pulse group consists of one ejection pulse.

9. The ink jet head drive device according to claim 1, wherein the first pulse group includes two ejection pulses.

10. A liquid dispensing head, comprising:

a piezoelectric plate including a pressure chamber;

an electrode in the pressure chamber;

a nozzle plate including a nozzle through which a liquid supplied from the pressure chamber is ejected when a drive signal including an ejection pulse is supplied to the electrode; and a drive circuit electrically connected to the electrode and configured to output the drive signal to the electrode as a drive waveform having a first pulse group and a second pulse group following the first pulse group when at least three consecutive ejection pulses are included in the drive waveform, wherein all ejection pulses in the first pulse group have a first voltage amplitude, all ejection pulses in the second pulse group have a second voltage amplitude that is smaller than the first voltage amplitude, and the second voltage amplitude, when supplied to the electrode, causes a droplet ejected by a last ejection pulse in the second pulse group to travel at a speed that is equal to or higher than a speed of a droplet ejected by a first ejection pulse in the first pulse group.

11. The liquid dispensing head according to claim 10, further comprising:

a switch connected to at least three voltage sources, each voltage source supplying a voltage with a different voltage amplitude, wherein the drive circuit controls the switch to connect one of the at least three voltage sources to the electrode.

12. The liquid dispensing head according to claim 10, wherein the drive circuit sets:

a pulse width of a first ejection pulse in the drive waveform as one half of an acoustic resonance cycle of the liquid in the pressure chamber, a pulse width of all remaining ejection pulses in the drive waveform as one half of the acoustic resonance cycle or less, and an interval between centers of two adjacent pulses in the drive waveform as the acoustic resonance cycle.

13. The liquid dispensing head according to claim 10, wherein the drive circuit is further configured to supply a negative pulse as the drive signal after the second pulse group of the drive waveform has been supplied to the electrode, the negative pulse having a voltage amplitude opposite in polarity to the first and second voltage amplitudes.

14. An ink supply device, comprising:

a supply-side ink tank;

a discharge-side ink tank connected to the supply-side ink tank via a tube;

an actuator configured to change a pressure on a liquid in a pressure chamber in response to a drive signal, the pressure chamber being in fluid communication with the supply-side ink tank and the discharge-side ink tank;

a nozzle plate including a nozzle connected to the pressure chamber and through which the liquid contained in the pressure chamber is ejected when an ejection pulse is supplied to the actuator; and a drive circuit configured to output the drive signal to the actuator as a drive waveform having a first pulse group and a second pulse group following the first pulse group when at least three consecutive ejection pulses are included in the drive waveform, wherein all ejection pulses in the first pulse group have a first voltage amplitude, all ejection pulses in the second pulse group have a second voltage amplitude that is smaller than the first voltage amplitude, and the second voltage amplitude, when supplied to the actuator, causes a droplet ejected by a last ejection pulse in the second pulse group to travel at a speed that is equal to or higher than a speed of a droplet ejected by a first ejection pulse in the first pulse group.

15. The ink supply device according to claim 14, further comprising:

a switch connected to at least three voltage sources, each voltage source supplying a voltage with a different voltage amplitude, wherein the drive circuit controls the switch to connect one of the at least three voltage sources to the actuator.

16. The ink supply device according to claim 14, wherein the drive circuit sets:

a pulse width of a first ejection pulse in the drive waveform as one half of an acoustic resonance cycle of the liquid in the pressure chamber, a pulse width of all remaining ejection pulses in the drive waveform as one half of the acoustic resonance cycle or less, and an interval between centers of two adjacent pulses in the drive signal as the acoustic resonance cycle.

17. The ink supply device according to claim 14, wherein the drive circuit is further configured to supply a negative pulse as the drive signal after the second pulse group of the drive waveform has been supplied to the actuator, the negative pulse having a voltage amplitude opposite in polarity to the first and second voltage amplitudes.

* * * * *